US007164867B2

(12) United States Patent
Yonenaga

(10) Patent No.: US 7,164,867 B2
(45) Date of Patent: Jan. 16, 2007

(54) METHOD AND APPARATUS FOR SELECTING IMAGE FORMING APPARATUS HAVING ENOUGH TONER

(75) Inventor: Kohtaroh Yonenaga, Tokyo (JP)

(73) Assignee: Ricoh Company, Ltd., Tokyo (JP)

( * ) Notice: Subject to any disclaimer, the term of this patent is extended or adjusted under 35 U.S.C. 154(b) by 93 days.

(21) Appl. No.: 10/968,316

(22) Filed: Oct. 20, 2004

(65) Prior Publication Data

US 2005/0141904 A1 Jun. 30, 2005

(30) Foreign Application Priority Data

Oct. 20, 2003 (JP) ..... 2003-359853
Oct. 18, 2004 (JP) ..... 2004-302977

(51) Int. Cl.
*G03G 15/08* (2006.01)
*G03G 15/01* (2006.01)
*G03G 15/10* (2006.01)

(52) U.S. Cl. ..... 399/27; 399/28; 399/61

(58) Field of Classification Search ..... 358/1.2, 358/1.9; 399/12, 13, 28, 30, 61, 62–65, 2 N
See application file for complete search history.

(56) References Cited

U.S. PATENT DOCUMENTS 4,770,403 A 9/1988 Katsumata et al.
4,916,547 A 4/1990 Katsumata et al.
5,287,198 A 2/1994 Fukuda et al.
5,414,535 A 5/1995 Kanmoto et al.
6,204,866 B1 3/2001 Yonenaga
6,483,603 B1 11/2002 Yonenaga
2002/0109856 A1 * 8/2002 Sasanuma et al. ..... 358/1.9

FOREIGN PATENT DOCUMENTS

JP 2001-100956 4/2001

* cited by examiner

*Primary Examiner*—Hoang Ngo
(74) *Attorney, Agent, or Firm*—Oblon, Spivak, McClelland, Maier & Neustadt, P.C.

(57) ABSTRACT

An image forming apparatus network system, which connects two or more image forming apparatuses on a network, that includes image forming apparatuses which receive image data of the object to be printed, have image creating engines for two or more colors, and have a linked interface that enables intercommunication with other machines. The image forming apparatus includes a remaining toner information acquiring unit that acquires information about amounts of remaining toner of the image creating engines, an image data volume computing unit that computes the amount of image data of objects to be created, and a main controller that selects a linked image forming apparatus in accordance with the amounts of remaining toner and image data and executes image forming operations.

17 Claims, 20 Drawing Sheets

| TONER | TONER CONSUMPTION PER 1000 PIXELS (mg) |
|---|---|
| CYAN | X |
| MAGENTA | Y |
| YELLOW | Z |
| BLACK | XX |

| | |
|---|---|
| SLAVE MACHINE 10B | REFILL OF TONERS REQUIRED |
| SLAVE MACHINE 10C | ENOUGH REMAINING TONERS |

FIG. 19

| ORDER OF PRIORITY | SLAVE MACHINE |
|---|---|
| 1 | B |
| 2 | D |
| 3 | A |
| 4 | C |
| 5 | E |
| . . . | . . . |

FIG. 21

| | |
|---|---|
| SLAVE MACHINE 10A | ENOUGH REMAINING TONERS |
| SLAVE MACHINE 10B | ENOUGH REMAINING TONERS |
| SLAVE MACHINE 10C | REFILL OF TONERS REQUIRED |
| SLAVE MACHINE 10D | ENOUGH REMAINING TONERS |
| SLAVE MACHINE 10E | ENOUGH REMAINING TONERS |

METHOD AND APPARATUS FOR SELECTING IMAGE FORMING APPARATUS HAVING ENOUGH TONER

CROSS-REFERENCE TO RELATED APPLICATIONS

The present document incorporates by reference the entire contents of Japanese priority documents, 2003-359853 filed in Japan on Oct. 20, 2003 and 2004-302977 filed in Japan on Oct. 18, 2004. The present document incorporates by reference the entire contents of Japanese application, 2002-123147 filed in Japan on Apr. 24, 2002.

BACKGROUND OF THE INVENTION

1) Field of the Invention

The present invention relates to selecting an image forming apparatus, from among a plurality of image forming apparatuses, that has enough remaining toner, and performing printing on the image forming apparatus selected.

2) Description of the Related Art

Japanese Patent Application Laid-Open No. 2001 100956 discloses a system where a plurality of image forming apparatuses, such as digital copiers, are connected to each other via a network so that the image forming apparatuses can perform intercommunication. An efficient utilization of memory devices and improved productivity of a system, for example, can be achieved on this system by detecting a state of use of memory devices of the image forming apparatuses in the system and by suitably allocating the memory devices to be used for a job.

However, if the conventional system includes color image forming apparatuses, and, an image forming apparatus, which is a master machine, allocates a job to another image forming apparatus, which is a slave machine, and, the slave machine has insufficient toner of a particular color, then accurate to an image data cannot be obtained.

In other words, whether the slave machine has enough toner is an important factor. In other words, if a specific toner is exhausted, the availability of printable colors is changed. Therefore, the printable colors will differ according to each mode and link to the image forming apparatus (master machine) and the status of remaining toner in a linked image forming apparatus (slave machine). In addition, the printable colors differ because the consumption of toner is different according to the original document to be copied.

SUMMARY OF THE INVENTION

It is therefore a first object of the present invention to at least solve the problems in the conventional technology.

An image forming apparatus network system according to an aspect of the present invention includes a first image forming apparatus connected with a plurality of second image forming apparatuses over a network. The first image forming apparatus includes an image creating unit that creates an image with at least one toner based on an image data to be printed; an image data volume computing unit that computes a volume of the image data; and a remaining toner information acquiring unit that acquires information on remaining toner from at least one of second image forming apparatuses; a controlling unit that computes toner consumption from the volume of image data computed by the image data volume computing unit, selects a second image forming apparatus that has an amount of remaining toner larger than the toner consumption computed, and sends a command to form an image at the second image forming apparatus selected. Each of the second image forming apparatuses include a toner detecting unit that detects an amount of remaining toner in a corresponding second image forming apparatus; and a notifying unit that notifies the first image forming apparatus of information about the remaining toner detected by the toner detecting unit.

An image forming apparatus according to another aspect of the present invention is connected via a network to a plurality of other image forming apparatuses and includes an image creating unit that receives image data to be printed and based on the image data forms images with at least one toner; an image data volume computing unit that computes a volume of the image data; a remaining toner information acquiring unit that acquires information on remaining toner from at least one of the other image forming apparatuses; and a controlling unit that computes toner consumption from the volume of image data computed by the image data volume computing unit, selects an image forming apparatus, from among the other image forming apparatuses, that has an amount of remaining toner larger than the toner consumption computed, and sends a command to form an image at the other image forming apparatus selected.

An image forming apparatus selection method according to still another aspect of the present invention is to be executed on a first image forming apparatus connected with a plurality of second image forming apparatuses over a network. The method includes the first image forming apparatus executing computing a volume of an image data to be printed; acquiring information on remaining, toner from at least one of second image forming apparatuses; computing toner consumption from the volume of image data computed; selecting a second image forming apparatus that has an amount of remaining toner larger than the toner consumption computed; and sending a command to form an image at the second image forming apparatus selected. Moreover, each of the second image forming apparatuses executing detecting an amount of remaining toner in a corresponding second image forming apparatus; and notifying the first image forming apparatus of information about the remaining toner detected, An image forming apparatus selection method according to still another aspect of the present invention is to be executed on an image forming apparatus connected with a plurality of other image forming apparatuses over a network. The method includes computing a volume of an image data to be printed; acquiring information on remaining toner from at least one of the other image forming apparatuses; computing toner consumption from the volume of image data computed; selecting one of the other image forming apparatus that has an amount of remaining toner larger than the toner consumption computed; and sending a command to form an image at the other image forming apparatus selected.

A computer program according to still another aspect of the present invention causes a computer to execute the image forming apparatus selection method according to the present invention.

A computer-readable recording medium according to still another aspect of the present invention stores therein the computer program according to the present invention.

The other objects, features, and advantages of the present invention are specifically set forth in or will become apparent from the following detailed description of the invention when read in conjunction with the accompanying drawings.

BRIEF DESCRIPTION OF THE DRAWINGS

FIG. 19 is an explanatory diagram of a sample table of priority ranking of slave machines;

FIG. 21 is an explanatory drawing of amounts of remaining toners at all slave machines;

DETAILED DESCRIPTION

Exemplary embodiments of an image forming apparatus network system, an image forming apparatus, an image forming apparatus selection method, and a computer product according to the present invention are explained below in reference to the accompanying drawings.

Figure 1:
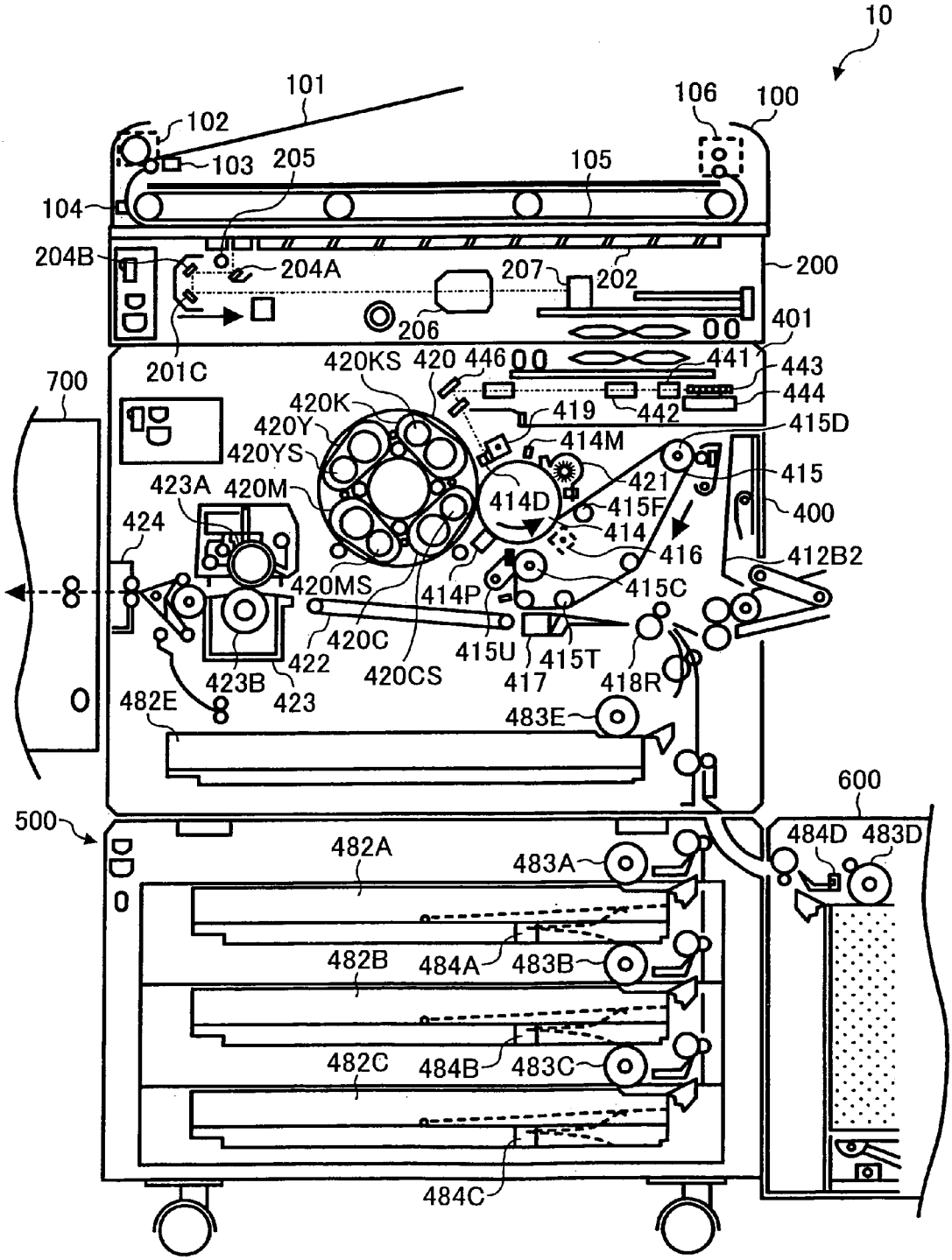
FIG. 1 is an explanatory drawing of a color image forming apparatus according to a first embodiment of the present invention.

First, an explanation of a configuration and sample operation of a color image forming apparatus according to a first embodiment is provided. FIG. 1 is an explanatory drawing of a configuration of the color image forming apparatus according to the first embodiment. FIG. 1 is a side view of a color laser digital copier that digitally processes and outputs full color images. The color laser digital copier has a revolver-type developing unit, however, the configuration is not limited to this. For example, it is permissible to use a tandem type developing unit. Moreover, it is permissible to use a black-and-white image forming apparatus.

The image forming apparatus is equipped with an automated document feeder (ADF) apparatus 100 that reads original texts, a scanner 200 that optically reads originals and outputs digital signals, a printing device 400 that forms color images, a paper feeding bank 500 that is loaded with trays that feed recording paper, a large-capacity paper tray 600 that is loaded with large amounts of recording paper, and a sorter 700 that separates and stacks the output papers by job or by page.

The ADF apparatus 100 is equipped with a document feeder 101 for the setting of reams of original texts, a text feeding unit 102 that is affixed to the document feeder 101 to draw out the original texts sheet-by-sheet, a text setting sensor 103 that detects the presence or absence of original texts, a conveyance sensor 104 that detects the timing and the like of the original texts that are being fed into the device, the text conveyance belt 105 that conveys original texts to an exposure glass 202 that is the position where original texts are read, and a text discharging unit 106 that discharges the original texts, which have already been read, onto the ADF apparatus 100.

The scanner 200 has the exposure glass 202 on which is placed the original texts which are to be read, mirrors 204A, 204B, and 204C that guide the reflections of the original text toward an appropriate direction, an illumination lamp 205 that irradiates the original texts, a lens that collects the reflected light of the original text that was obtained by the illumination, and a charge coupled device (CCD) image sensor 207 that reads the reflected light of the original text that is light gathered by a lens 206 line-by-line and outputs this line-by-line informing as image data.

In other words, the scanner 200 includes the exposure glass 202, on which the original text is positioned, and an optical scanning unit. The optical scanning unit includes the illumination lamp 205, the mirror 204A, the lens 206, the CCD image sensor 207 and the like. The illumination lamp 205 and the mirror 204A are affixed on a first carriage (not shown). The mirrors 204B and 204C are affixed to a second carriage (not shown). When the original text is to be read, the first carriage and the second carriage mechanically scan at a relative speed with a ratio of two to one so that the length of an optical path does not change. This optical scanning unit is driven by a scanner drive motor (not shown).

The printing device 400 is equipped with an image fixing unit 423 that includes an optical reading unit 401, a photosensitive drum 414, a revolving image-developing unit 420, an intermediate transfer belt 415, an electrostatic discharger 419, a photosensitive drum cleaning unit 421, a delivery unit 422, an image fixing roller 423A, and a pressurization roller 423B; and a paper discharging unit 424. Moreover, the printing device 400 is equipped with a manual paper-feeding unit 412B to manually feed special types of paper.

The optical reading unit 401 includes a laser diode 441, a light-emitting drive controlling unit (not shown) that drives light-emissions from the laser diode 441, a polygonal mirror 443, a polygonal scanner motor 444, an fθ lens 442, and a reflective mirror 446.

A BK developing member 420K that performs developing with black (BK) toner, a C developing member 420C that performs developing with cyan toner (C), an M developing member 420M that performs developing with magenta toner (M), and Y developing member 420Y that performs developing with yellow toner (Y) are positioned in revolver positions in the revolving image-developing unit 420. In these developing members, developing sleeves 420KS, 420CS, 420MS, and 420CS are held by magnetic rollers to hold developing material (carriers) that maintain the toners.

The intermediate transfer belt 415 is equipped with a driving roller 415D, an opposing transfer roller 415T, an opposing cleaning roller 415C, an opposing transfer roller 415F, and a group of subordinate rollers. The intermediate transfer belt is driven by a drive motor (not shown). A belt cleaning member 415U is positioned after the copying position of the intermediate transfer belt 415 and removes excess toner after copying is done. The belt cleaning member 415U includes an entrance seal, a rubber blade, an excess toner ejection coil, and a structure to move the entrance seal and the rubber blade into and out of contact with the intermediate transfer belt 415. Further, on the underside of the intermediate transfer belt 415, there is a corona discharge copying unit 416 to print onto the recording paper from the intermediate transfer belt 415 by means of corona discharge method using alternating current plus direct current (AC+DC) or direct current (DC) in order to make overlapping toner images easier to copy onto recording paper. Moreover, on the inner side of the intermediate transfer belt 415, the corona discharge copying unit 416 is placed for use in processing copies.

In addition to the units mentioned above, an electrical charge neutralization lamp 414M, an electrical potential sensor 414D to detect the electrical potential of a latent image on the photosensitive drum 414, and a device to detect density of developed images 414P are positioned around the photosensitive drum 414 in fixed positions.

The paper feeding bank 500 accommodates a triple-tier of pull-out type cassettes 482A, 482B, and 482C. Paper size sensors 484A, 484B, and 484C detect the sizes of the recording papers, and paper feeding rollers 483A, 483B, and 483C feed recording paper from either of the cassettes. Similarly, a large-capacity paper tray 600 is equipped with a paper feeding roller 483D and a conveyance sensor 484D is positioned directly behind the paper feeding roller.

Next is an explanation of operations of the image forming apparatus according to the first embodiment. First, a ream of original texts is placed on the document feeder 101 of the ADF apparatus 100 with original text face up. A start key on the operations controlling device is pressed. The text feeding unit 102 sends the bottom most original text to the exposure glass 202 by means of a feeding roller and the text conveyance belt 105 of the text feeding unit 102. The scanner 200 reads image data of the original text, which is on the exposure glass 202, and the read original text is discharged by the text conveyance belt 105 and the text discharging unit 106. Moreover, if the text setting sensor 103 detects the presence of the next sheet of original text on the document feeder 101, then the next sheet of original text is fed to the exposure glass 202. The text feeding unit 102, the text conveyance belt 105, and the text discharging unit 106 are driven by a motor (not shown).

The scanner 200 irradiates the original text on the exposure glass 202 with the illumination lamp 205. Light reflected from the original text is guided by the mirrors 204A, 204B, and 204C to the lens 206. The lens 206 concentrates the light to the CCD image sensor 207. The CCD image sensor 207 transforms the read image data into electrical signals and outputs the read image data in the form of the electrical signals. The image data undergoes a prescribed image processing, the scanner 200 supplies this image data to the optical reading unit 401. In this manner, the scanner 200 obtains image data of one color with one scan.

Laser modulation is done in response to the image data sent to the optical reading unit 401, and after electrostatic charging this image data is written onto the photosensitive drum 414. After an image is developed, this image is copied onto the intermediate transfer belt 415. This operation is done in the order of BK (black), C (cyan), M (magenta), and Y (yellow).

In the waiting mode, the revolving image-developing unit 420 is set in the position to develop images using the BK developing member 420K. When copying starts, the scanner 200 starts to read black image data according to a prescribed timing. Image writing by laser light and the forming of an electrostatic latent image is done in accordance with the image data that was obtained. Hereinafter, an electrostatic latent image in accordance with black image data is called a "latent black image", an electrostatic latent image in accordance with cyan image data is called a "latent cyan image", an electrostatic latent image in accordance with magenta image data is called a "latent magenta image", and an electrostatic latent in accordance with yellow image data is called a "latent yellow image".

An image can be developed from the front-end of this latent black image. Before reaching the front-end of the BK developing member 420K, the BK developing sleeve 420KS starts revolving and develops the latent black image using black toner. Subsequently, developing of the field of the latent black image continues, and when the back-end of the latent image section passes the position of the latent black image the revolving image-developing unit 420 is revolved to proceed with the next developing member (C developing member 420C). The revolving operation is completed at least before the front-end of the latent image of the next image data is reached.

When the image forming cycle commences, the photosensitive drum 414 revolves in a counter-clockwise direction, and the intermediate transfer belt 415 revolves in a clockwise direction. Along with the revolving of the intermediate transfer belt 415, the forming black toner image, the forming of cyan toner image, the forming of magenta toner image, and the forming of yellow toner image is done consecutively. Finally, an overlapping toner image is formed on the intermediate transfer belt 415 in the order of black, cyan, magenta, and yellow.

The black image is formed in the following manner. The electrostatic discharger 419 discharges, by means of corona discharge, a uniform negative electrical charge of approximately −700 volts is applied on the photosensitive drum 414. Next, a raster light exposure is done by the laser diode 441 in accordance with the black image data. When the raster image is exposed to light, the sections that were exposed to light on the photosensitive drum 414, which had been uniformly electrically charged initially, lose their electric charge in proportion to the amount of light exposure and a latent electrostatic image is formed in accordance with the image data.

Toner within the revolving image-developing unit 420 is electrically charged with negative polarity by agitation with the ferrite carrier. Moreover, the BK developing sleeve 420KS has an bias due to the overlapping of negative direct current potential and the alternating current caused by an electrical power circuit (not shown) of the metallic base layer of the photosensitive drum 414. As a result, toner will not adhere on the sections of the photosensitive drum 414 where electrical charge remains, and a visible black image similar to the latent image is formed.

In this way, the black toner image formed on the photosensitive drum 414 is copied by means of the corona discharge copying unit onto the surface of the intermediate transfer belt 415 which is driven at a uniform speed while in contact with the photosensitive drum 414. This toner image copying from the photosensitive drum 414 to the intermediate transfer belt 415 is called belt copying. Sometimes a slight amount of unused (residual) toner remains on the photosensitive drum 414. The residual toner is scraped off from the photosensitive drum 414 by the photosensitive drum cleaning unit 421 and retrieved for reuse. The recovered toner goes through a recovery pipe for storage in a toner collection tank.

The intermediate transfer belt 415 sequentially overlays the belt copy images in four colors over the surface of the photosensitive drum 414 using black, cyan, magenta, and yellow toner images. Then, a corona discharge copying device 417 copies-the toner images as an aggregate onto recording paper.

At the photosensitive drum 414, after completion of formation of the black image, the scanner 200 proceeds to formation of the cyan image at the prescribed timing. The scanner 200 starts to read cyan image data, and laser writing in accordance with that image data is done to form the latent cyan image. After the back-end of the latent black image has been passed but before the front-end of the latent cyan image has been reached, the C developing member 420C will drive the revolving image-developing unit 420 and the latent cyan image is developed using cyan toner. The developing of the field of the latent cyan image continues and, in the same way as the BK developing member 420K operated, the revolving image-developing unit 420 moves the C developing member 420C away and moves the M developing member 420M to the image developing position. This operation is also done before the front-end of the latent magenta image member reaches the developing portion. The magenta and yellow images are formed in the same manner as the latent black and the latent cyan image.

After an image with the first color (the black image) has been copied, and while images with colors two, three, and four are copied onto the belt, the entrance seal and the rubber blade from the intermediate transfer belt 415 are moved away from the intermediate transfer belt 415.

In this manner, the toner image formed on the intermediate transfer belt 415 is copied onto a recording paper extracted from paper feeding sections, such as the recording paper stocked in a paper feeding tray 482E, the paper feeding bank 500, or the large-capacity paper tray 600. Each paper feeding roller 483E or the paper feeding rollers 483A, 483B, 483C, or 483D feeds the recording paper. The recording paper passes through the conveyance route to the appropriate position on the photosensitive drum 414 by means of a resist roller 418R, and then enters temporary wait mode.

Then, just when the front-end of the toner image on the intermediate transfer belt 415 reaches the corona discharge copying device 417, the front-end of the recording paper (which has the prescribed blank boundary spaces) reactivates the resist roller 418R to coincide with the front-end of that image to match the positions of the image and record paper. In this manner, the recording paper is positioned upon the overlapping colors on the intermediate transfer belt 415 and passes over the corona discharge copying device 417 which now has a positive electrical charge.

At this time, the corona discharge copying device 417 charges the recording paper with positive electrical charge, and most of the toner image is copied onto the recording paper. When the recording paper passes through a separation-type electrical charge removing device, which is an electrical charge neutralization brush (not shown), positioned on the left-side of the corona discharge copying device 417, the electrical charge is removed. The recording paper is then detached from the intermediate transfer belt 415 and moved to the delivery unit 422.

The recording paper with the four overlapping toner images is carried by the delivery unit 422 to the image fixing unit 423 in a nip section of the image fixing roller 423A and the pressurization roller 423B, where the toner images are fused. The recording paper is then delivered to the sorter 700 or stack tray by the paper discharging unit 424.

After copying, the surface of the photosensitive drum 414 is cleaned by the photosensitive drum cleaning unit 421 that is of a fur brush, a rubber blade, and the like. Moreover, the electrical charge neutralization lamp 414M uniformly neutralizes the electrical charge on the photosensitive drum 414, restoring the initial condition of the drum in preparation for the next image forming. Also, after copying, the surface of the intermediate transfer belt 415 is cleaned by the blade of the belt cleaning member 415U.

For repetitive copies, the operation of the scanner 200 and image forming on the photosensitive drum 414 proceeds, after processing of the fourth color on the first sheet is completed, at a prescribed timing for image processing of the first color of the second sheet. After the processing for copying the four overlapping color images onto the first sheet, the surface of the intermediate transfer belt 415, which was cleaned by the belt cleaning member 415U, is readied for copying of the second black toner image.

The image data read by the scanner 200 is written onto the photosensitive drum 414 by a laser beam from the optical reading unit 401. Toner images are formed by passing image data through the revolving image-developing unit 420, and copied onto a recording paper by the intermediate transfer belt 415. The recording paper is conveyed at a uniform speed by rotation of the intermediate transfer belt 415. Later, the recording paper is conveyed by the delivery unit 422 to the image fixing unit 423 where the images are fixed, and then discharged by the paper discharging unit 424.

The photosensitive drum 414, the delivery unit 422, the image fixing unit 423, the paper discharging unit 424, and the revolving image-developing unit 420 are driven by a main motor. The paper feeding roller 483E is driven by a transference drive of a paper feeding clutch of the main motor.

The original text image is read by the CCD image sensor 207, converted into electrical signals (analog image signals), and then converted into digital data (image data). Image data has already undergone various types of image processing. Image magnification is changed by moving the lens 206 and the CCD image sensor 207 in FIG. 1 in the left or right directions. In other words, the positions of the lens 206 and the CCD image sensor 207 are set in the left or right directions in response to the designated magnification.

Figure 2:
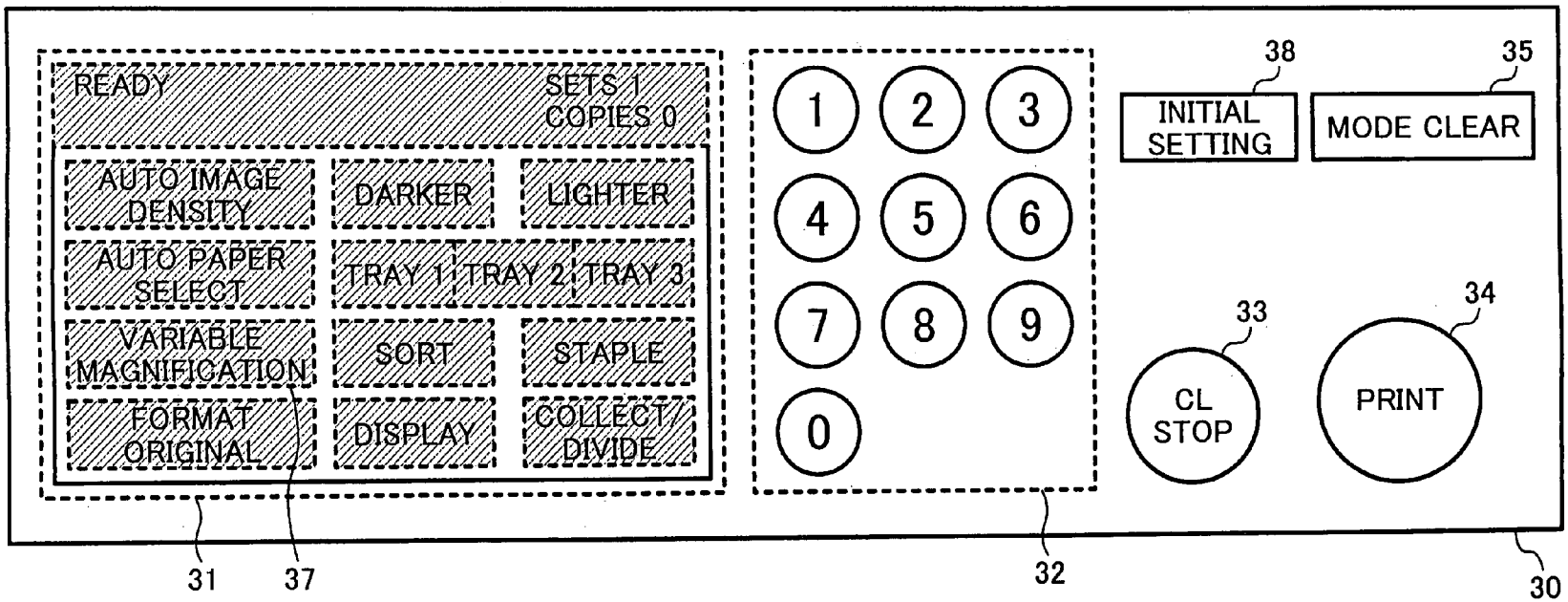
FIG. 2 is an explanatory drawing of an operations controlling unit of the color image forming apparatus shown in FIG. 1.

FIG. 2 is an explanatory drawing of an operations controlling unit 30 according to the first embodiment. The operations controlling unit 30 includes a liquid crystal touch-sensitive panel 31, a number-key pad 32, a clear/stop key 33, a print key 34, and a mode clear key 35. The liquid crystal touch-sensitive panel 31 displays function keys 37 and messages indicating the number of copies and status of the image forming apparatus.

Figure 3:
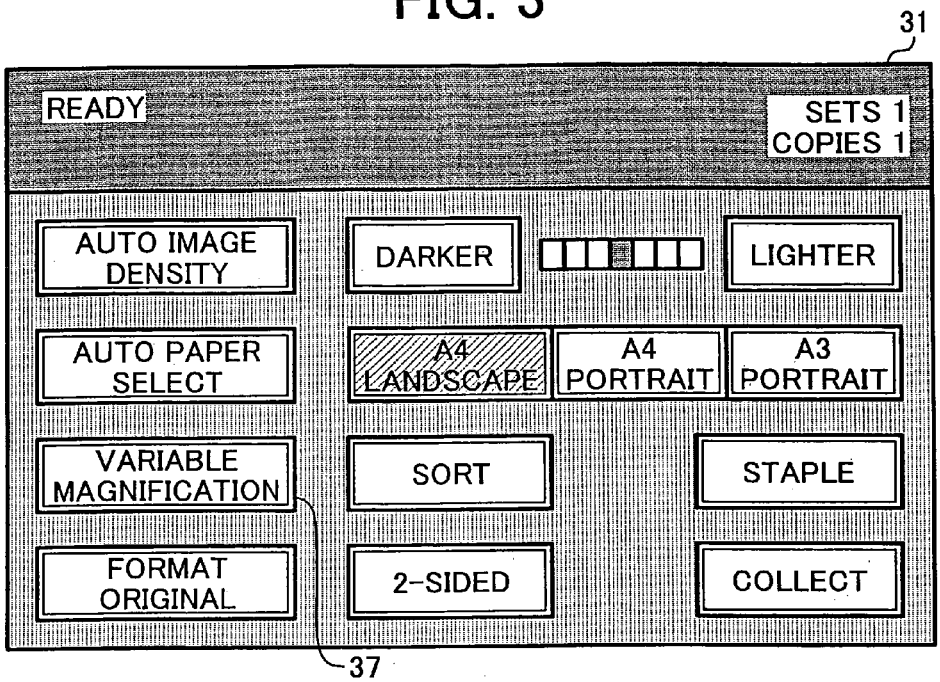
FIG. 3 is an explanatory drawing of a sample display on a liquid crystal touch-sensitive panel of the operations controlling unit shown in FIG. 2.

FIG. 3 is a detailed drawing of an example display of the liquid crystal touch-sensitive panel 31. When the operator touches a function key displayed on the liquid crystal touch-sensitive panel 31, that key is displayed in dark color. Moreover, when detailed functions are to be set (for example, when magnification is to be set), a display for setting the detailed functions is shown when a user touches a key. The liquid crystal touch-sensitive panel 31 is, for example, a dot display device, and graphically shows the display most appropriate at a particular time since.

Figure 4:
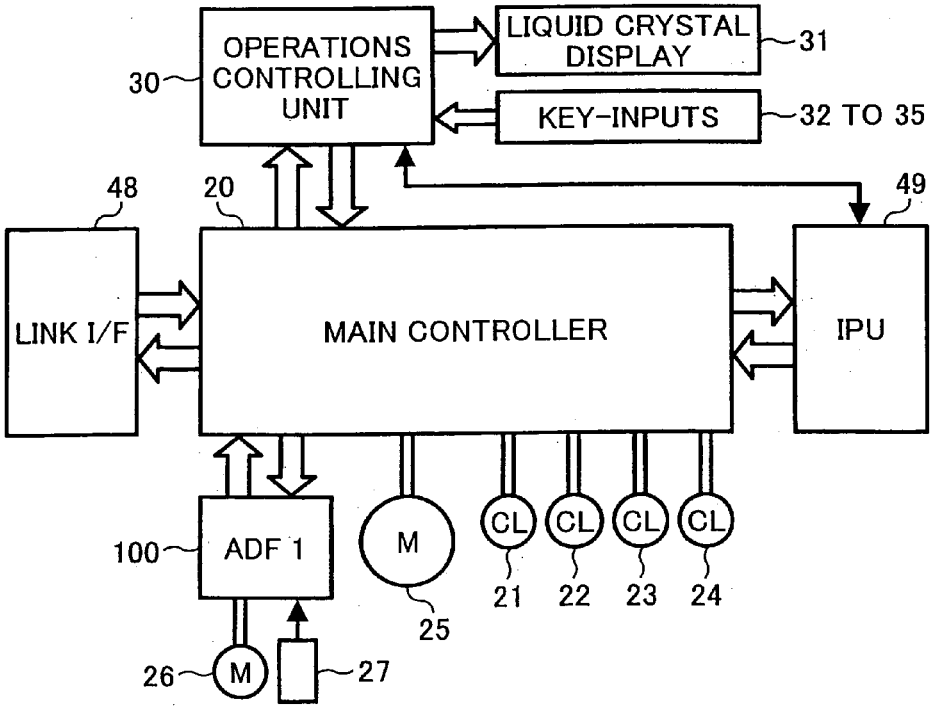
FIG. 4 is a block diagram of a controlling system that includes a main controller.

FIG. 4 is a block diagram of a controlling apparatus in the image forming apparatus. The controlling apparatus includes a main controller 20 that controls the entire image forming apparatus. The main controller 20 is connected to distributed controlling apparatuses such as the operations controlling unit 30 for the operator to control the input of function settings, an image processing unit (IPU) 49 that controls the scanner 200, writing of original text images into an image memory, and creation of images from the image memory, and the ADF apparatus 100. This main controller 20 is equivalent to the first controlling unit of the present invention.

A link I/F 48 is connected to the main controller 20 in order to connect with a plurality of image forming apparatuses to send and receive information relating to configurations, functions, and operations of the apparatuses. The main controller 20 acquires information about the image forming apparatuses through the link I/F 48 and linking operations are controlled by setting of the operations; or the main controller controls the operations of its own machine after receiving commands from another image forming apparatus. Each of the distributed controlling devices and the main controller 20 will interact according to the status of the equipment and operational commands as required.

Figure 7:
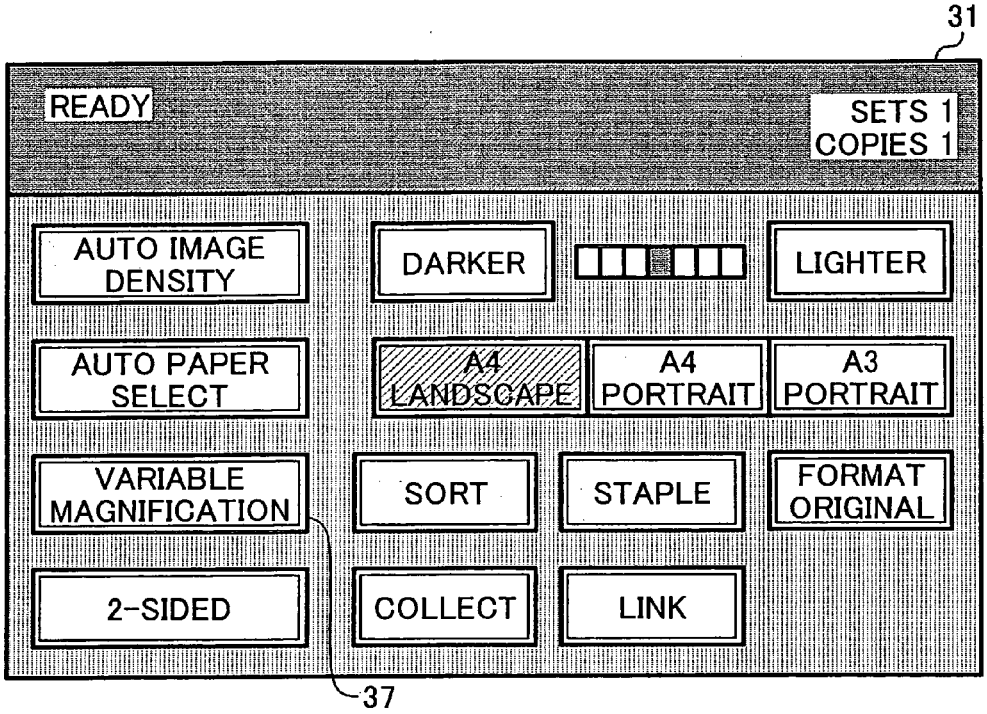
FIG. 7 is another explanatory drawing of a sample display on the liquid crystal touch-sensitive panel of the operations controlling unit in FIG. 2.

Moreover, the main controller 20 controls a main motor 25, which is required for conveyance of recording paper, and various type of clutches 21 to 24. FIG. 7 is an example of the display section for setting the sending or receiving of signals to or from the connected image forming apparatus. By touching the "link" key, a setting for linked operations utilizing a plurality of interconnected image forming apparatuses is selected so the machine whose "link" key was touched becomes the master machine for linked operations which can command operations at other image forming apparatuses (slave machines).

Figure 5:
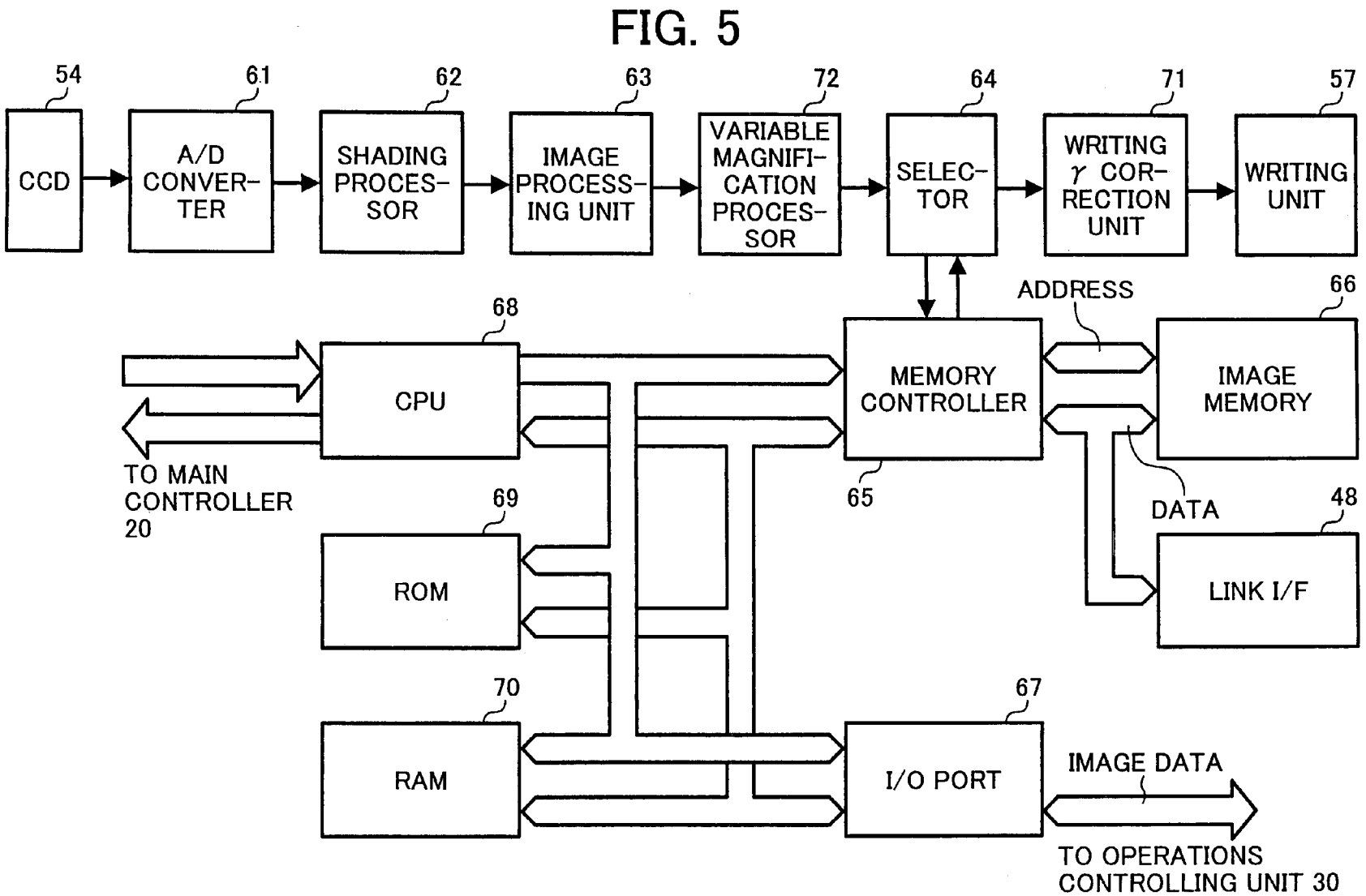
FIG. 5 is a block diagram of an internal configuration of an image processing unit (IPU) of the controlling system shown in FIG. 4.

FIG. 5 is a block diagram of an internal structure of the IPU 49. A reflection of light irradiated from an exposure lamp 51 is photoelectrically converted at a CCD imaging sensor 54, and converted to digital signals at an A/D converter 61. After shading correction is performed at a shading processor 62, image signals undergo MTF correction, γ-correction, and the like at an image processing unit 63. The image signals then pass through a variable magnification processor 72 and are enlarged or reduced to match the set magnification, and then pass to a selector 64. At the selector 64, destinations of the image signals are switched between a writing γ-correcting unit 71 or an image memory controller 65. The image signals which pass through the writing γ-correcting unit 71 have their writing γ-characteristics corrected to match image creation conditions, and are then sent to a writing unit 57. A connection between the image memory controller 65 and the selector 64 is configured to enable two-way input and output. Moreover, there are ROM 69 and RAM 70 to store settings of the image memory controller 65, a CPU 68 that controls a reading unit 50 and the writing unit 57, and computer programs and data. Further, the CPU 68 executes writing and reading of data of an image memory 66, which is a sequential memory, through the image memory controller 65.

The link I/F 48 is connected to a data bus of the image memory controller 65 to execute data input and output and configured to enable input and output of data in order to send and receive image information. Image information is forwarded through the image memory 66 in accordance with the data transmission speed between the image forming apparatuses. In other words, after image data from the image memory controller 65 is stored in the image memory 66 when image data is output, data is read from the image memory 66 in accordance with the data transmission speed between the image forming apparatuses, and this data is then forwarded to the link I/F 48. After image data that was forwarded from the link I/F 48 during image output is stored in the image memory 66, image data is processed within the image forming apparatus from the image memory via the image memory controller 65. By means of the structure explained above, functions of the image forming apparatus are free from limitations and it is possible to actualize linked operations.

Images that were sent to the image memory controller 65 as original text images after being compressed within the image memory controller 65 by an image compressing unit, are sent to the image memory 66. The reason for compressing the images is that, although data having a maximum image size of 256 gradations can be written as-is in the image memory 66, one sheet of original text image occupies an extremely large volume of the image memory 66. By compressing the images, it is possible to effectively utilize the limited image memory capacity. As a result, the image memory 66 can store more data at one time, and this capability can be used as a sorting function so the image memory can output the stored original text image data by page sequence. When using the image memory in this manner, the data of the image memory 66 is output while being sequentially elongated within the image memory controller 65. A function such as this is generally called "electronic sorting".

Also, using the functions of the image memory 66, it is possible to sequentially read divided areas of an image memory corresponding to one sheet of recording paper. For example, an original text image which corresponds to one sheet of recording paper is sequentially written as four equal parts. It is then possible to combine the four parts into one composite image of recording paper and output a copy. This type of function is generally called "aggregate copying".

The image memory 66 is structured to enable access from the CPU 68. This accessibility makes it possible to work on the contents of the image memory 66; for example, pixel skipping processing, excision of images, and the like. Among the types of work possible, it is possible to process the image memory 66 by writing data into the registers of the image memory controller 65. The image that was reworked is once again retained in the image memory 66.

Moreover, the CPU reads the contents of the image memory 66 and forwards, via an I/O port 67, this image data 73 to the operations controlling unit 30. Generally, since the resolution of the display of the operations controlling unit 30 is low, the original image of the image memory 66 is thinned out and sent to the operations controlling unit 30.

The image memory 66 may use a hard disk in order to store much image data. By using a hard disk, external power supplies are unnecessary and it is possible to maintain images permanently. It is common to use a hard disk to maintain a plurality of standard original texts (formatted texts) that were read by the scanner 200.

Figure 6:
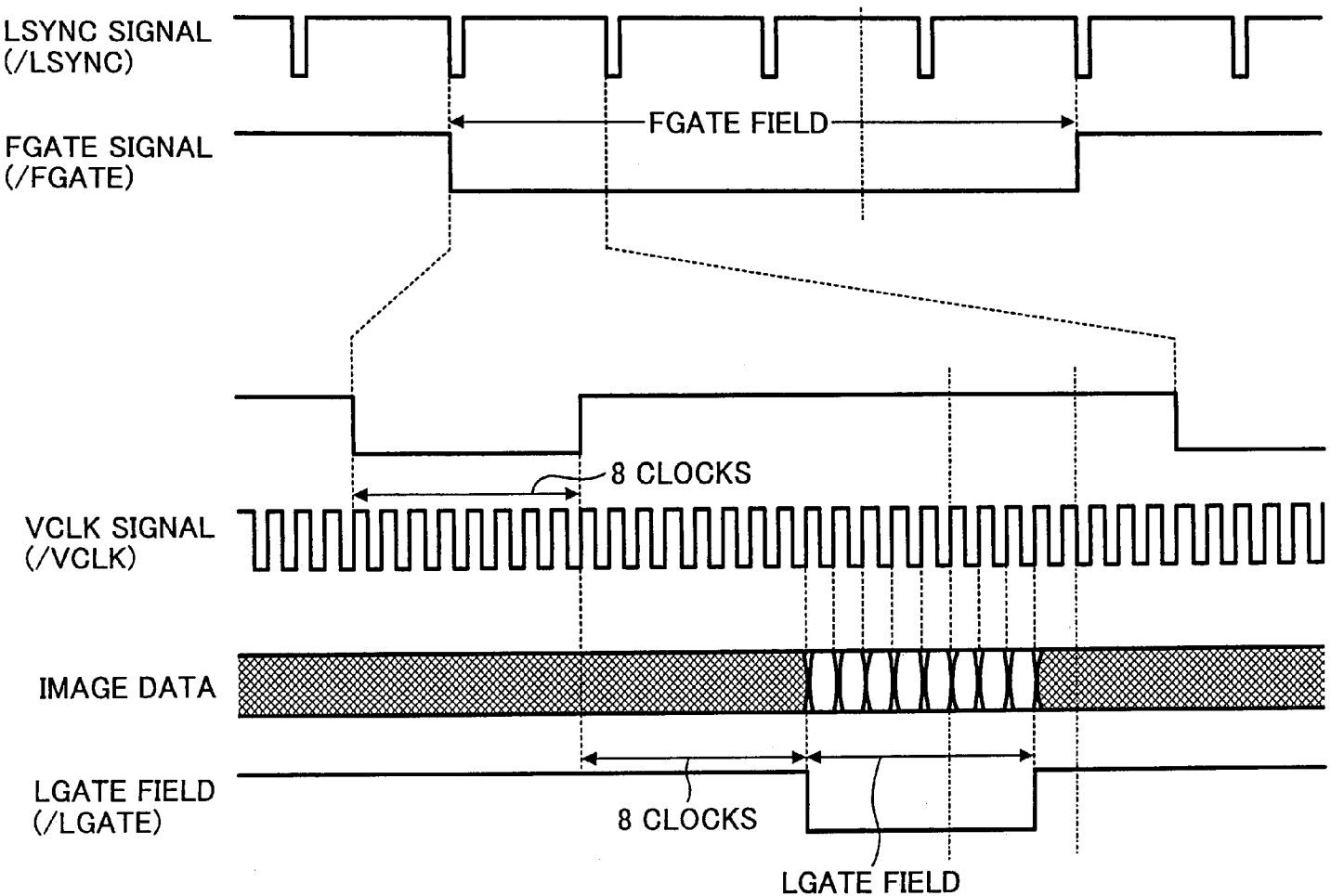
FIG. 6 is a timing chart of activities to process one page of image data.

Next, how the selector 64 processes one sheet of image data will be explained here with reference to FIG. 6. FIG. 6 is a timing chart of the operations to process one page of image data. A frame gate signal (hereinafter, "/FGATE") indicates a period of validity for one direction of a sub-scan of the image data within one page. A main scan activating signal (hereinafter, "/LSYNC") occurs for each scanning line, and validates image data using a predetermined clock after the /LSYNC starts up.

Line gate signal (hereinafter, "/LGATE") is a signal to indicate the image data in a main scanning direction is valid. The /FGATE, /LSYNC, and /LGATE are synchronized with a pixel synchronizing signal (hereinafter, "VCLK"), and data of one pixel is sent for one cycle of VCLK.

Moreover, although a detailed explanation will be omitted, the IPU 49 has functions to generate one of either /FGATE, /LSYNC, /LGATE, or VCLK for each of the images input or output. It is possible to actualize the input and output of various combinations of images by executing phase alignment in cases of direct output of original text that is the read original text image (image data).

In other words, FIG. 6 represents the image signals of one page in the selector 64. /FGATE is the period of validity of the direction of sub-scans of image data in one page. /LSYNC is the main scanning synchronizing signal for each line and validates an image signal using a predetermined clock after the /LSYNC signal starts up. The /LGATE is a signal showing that image signals in a main scanning direction are valid. These signals are synchronized to the pixel clock VCLK, and data of 8 bits per pixel (256 gradations) are synchronized with one cycle of VCLK. Further, according to this embodiment, image data are white images which are close to 255 bits.

FIG. 7 is another explanatory drawing of a sample display on the liquid crystal touch-sensitive panel 31.

Figure 8:
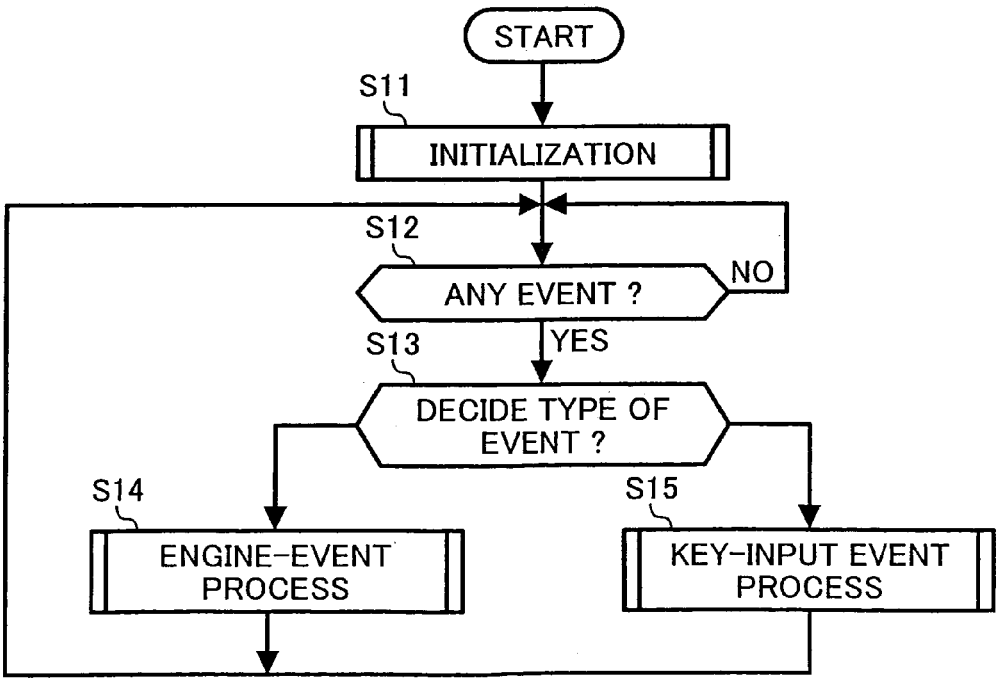
FIG. 8 is a flowchart of the main operations performed by the main controller shown in FIG. 2.

FIG. 8 is a flowchart of main operations. First, power is turned on, and an initialization process is executed (step S11). The main contents of initialization are resetting of each flag, clearing of each type of counter, clearing of the image memory 66, and resetting of an image forming mode (variable magnification power, division of images, and the like). The initialization process will not be described here in detail. After initialization, the user inputs by keys, or waits for an event from image forming engines (some kind of cause of change) to occur (step S12). If the user does some kind of input by keys, the operations controlling unit 30 notifies the user about an event that is an input by keys. In a similar manner, some kind of change in the image forming engine, for example, original text is set in the ADF apparatus 100, a change of the signal of the text setting sensor 103 will be sent as a notice of an engine event. When an event at a key of the operations controlling unit 30 or image forming engine occurs, the system control proceeds to step S13. In step S13, it is determined whether the event is key input or an engine event. If the event is an engine event, an engine-event processing is performed at step S14. If the event is a key input, a key-input event processing is performed at step S15.

Figure 9:
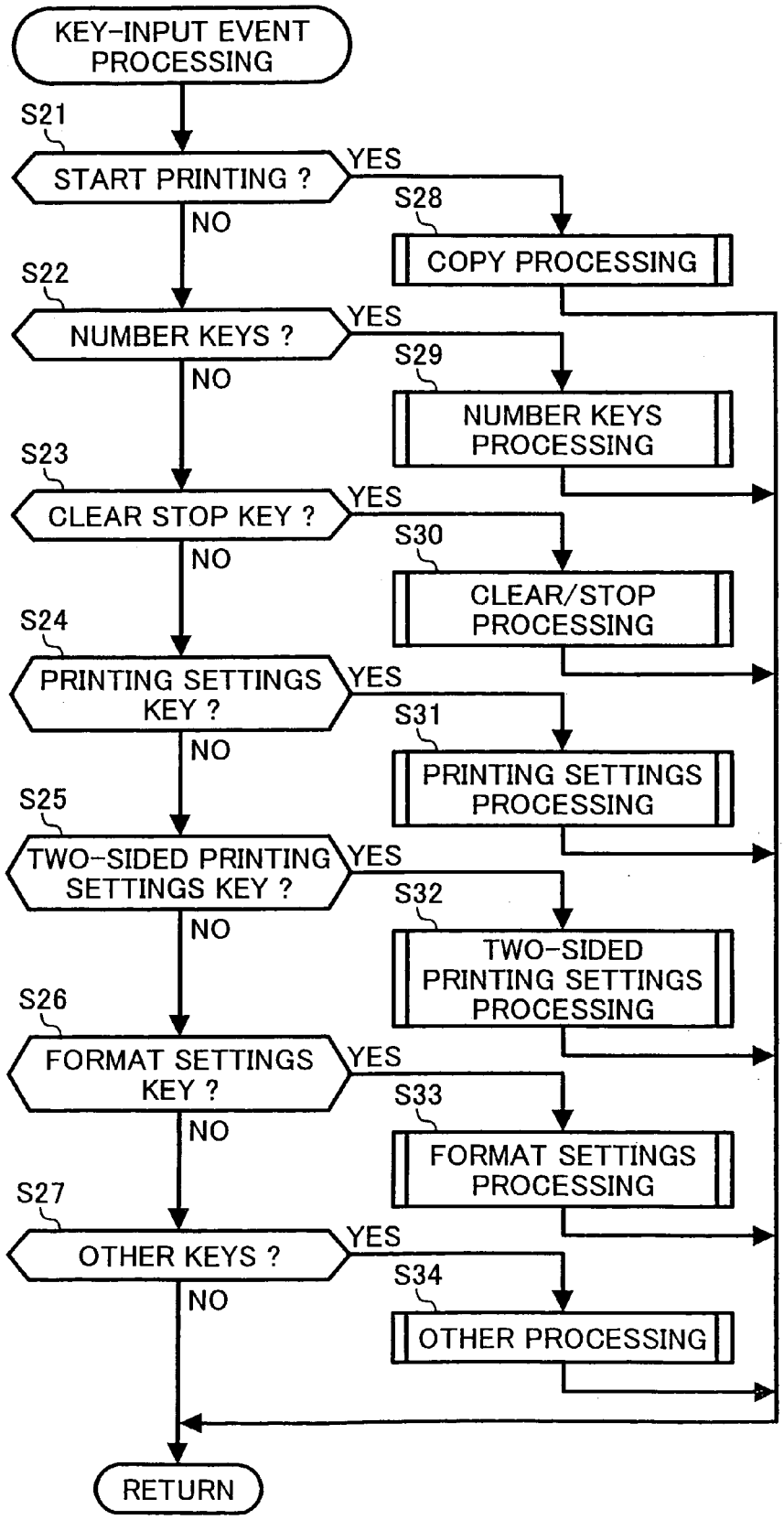
FIG. 9 is a detailed flowchart of a key-input event processing in FIG. 8.

FIG. 9 is a flowchart of details of the key-input event processing. In step S21, it is checked whether a print start key is pressed. If the print start key is pressed, a copying processing is performed at step S28. In step S22, it is a checked whether a number-key on the number-key pad 32 is pressed. If the number-key is operated, a number-key processing is performed at step S29. In step S23, it is a checked whether a clear stop key is pressed. If the clear/stop key 33 is pressed, a clear/stop processing is performed at step S30. In step S24, it is a checked whether a printing settings key is pressed. If the printing settings key is pressed, a printing settings processing is, performed at step S31.

In step S25, about it is decided whether two-sided printing settings key is pressed. If the two-side printing setting key is pressed, a two-sided printing settings processing is performed at step S32. In step S26, it is decided whether a format settings key is pressed. If the format settings key is pressed, a format settings processing is performed at step S33.

In step S27 it is decided whether any key other than those mentioned in steps S21 to S26 is pressed. If any other key is pressed, other processing is performed at step S34. When any one of the processing mentioned in steps S28 to S34 is completed the system control returns to the initial state.

Figure 10:
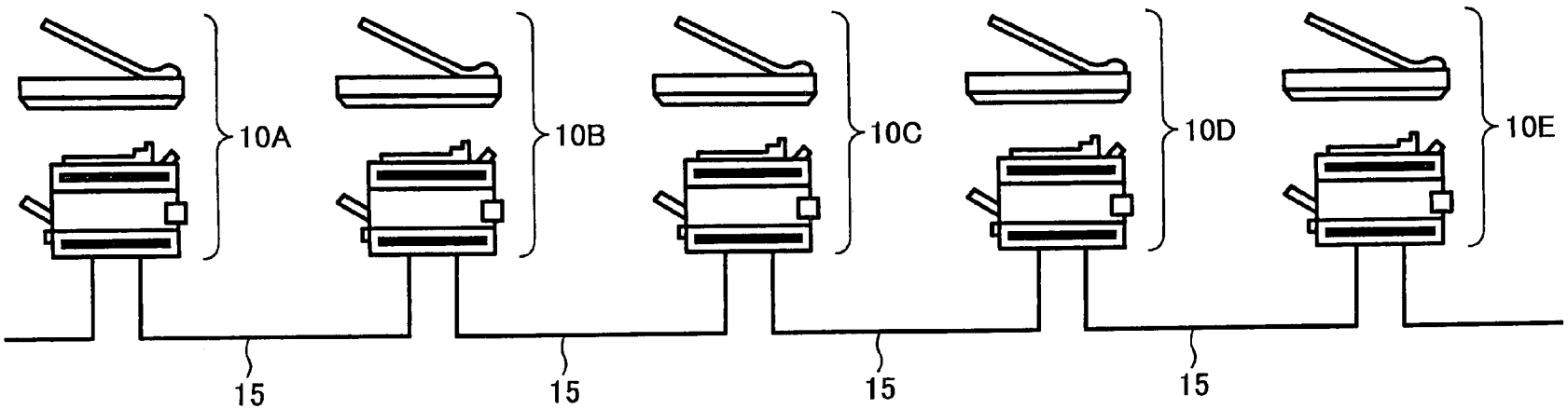
FIG. 10 is an explanatory drawing of image forming apparatuses connected via a network.

As shown in FIG. 10, image forming apparatuses 10A to 10E are may be connected to each other by LAN cables to a network 15. The image forming apparatus according to the first embodiment is used as the image forming apparatuses 10A to 10E. Each image forming apparatus is connected by means of the link I/F 48, such as IEEE1394. This IEEE1394-1995 (year 1995, Physical Layer PHY, Link Layer LINK) are standards of hardware and software for 100 Mbps, 200 Mbps, and 400 Mbps data transfer. IEEE1394-1995 is a serial bus that makes high-speed connection between digital equipment possible.

Further, 800 Mbps, 1.6 Gbps, and 3.2 Gbps are under consideration for the future. IEEE1394 provides distinguishing functions including plug-and-play and multimedia data transfer. IEEE1394 secures bandwidth for video and voice data, and has a function (isochronous data transfer) that makes transfers in real-time possible. Data transfer methods of IEEE1394, as described below, can be divided into isochronous transfer and asynchronous transfer.

1. Isochronous Transfer

A special feature of isochronous transfer is the guaranteeing of data transfer speed. In concrete terms, at least one packet can be sent every 125 microseconds per channel, 64 channels of talkers and listeners can be set per node, and the maximum packet size is decided by data transfer speeds of 100 Mbps, 200 Mbps, or 400 Mbps.

2. Asynchronous Transfer

Asynchronous transfer cannot occur until after all isochronous transfer has been completed. Isochronous transfer employs the concept of channels, which has some similarities to broadcast in which a talker has a transmission function and a listener has a receiving function; but asynchronous transfer is point-to-point. Each transaction contains IDs relating to transmitting source and destination.

Figure 11:
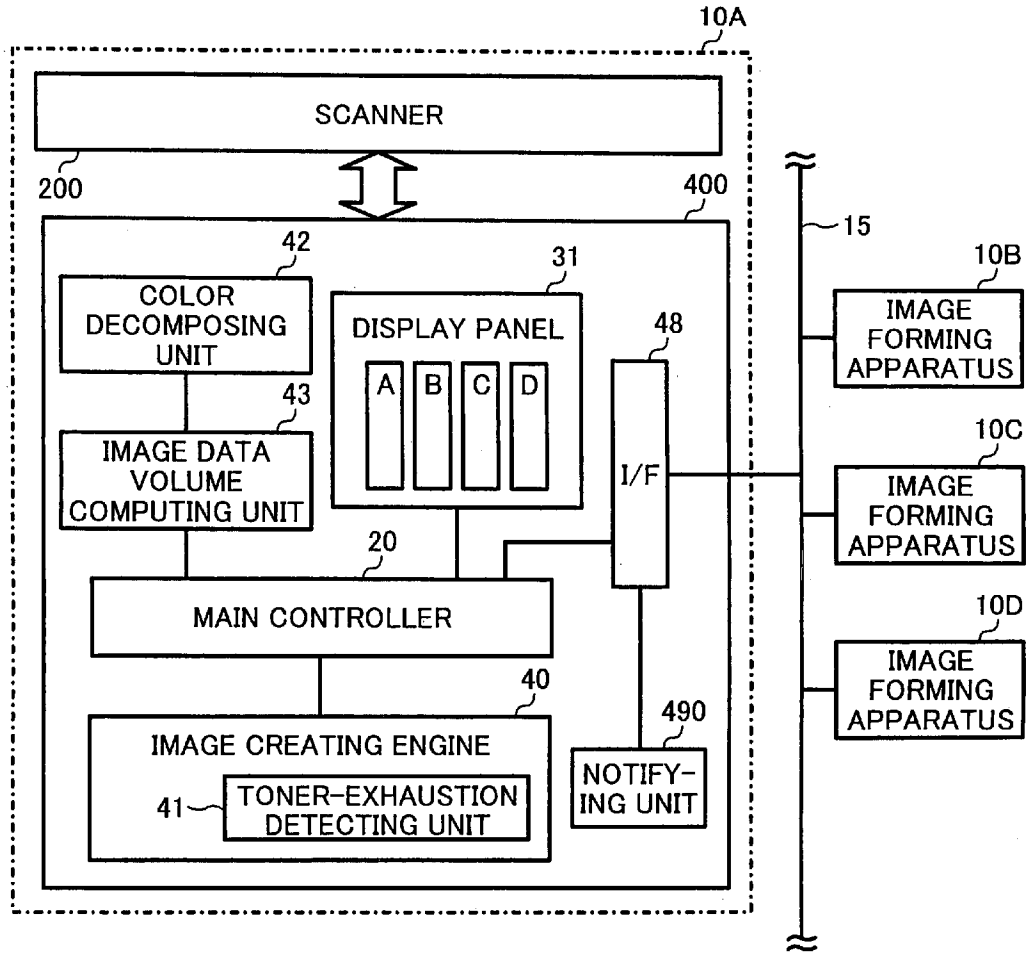
FIG. 11 is a schematic of a network system in which the image forming apparatus according to the first embodiment is connected to other apparatuses via a network.

FIG. 11 is a block diagram of the image forming apparatus 10A, and also illustrates the network 15 for connecting the image forming apparatus 10A to the image forming apparatuses 10B to 10D. The image forming apparatus 10A includes an image creating engine 40 that forms color images. The image creating engine 40 includes a toner-exhaustion detecting unit 41 that detects whether toner is exhausted in each developing device. The image forming apparatus 10A further includes a color decomposing unit 42 that decomposes images read by the scanner 200 into each color, an image data volume computing unit 43 that computes amounts of toner consumption for each color, and a notifying unit 490 that sends notices to other image forming apparatuses on the network 15 about the decision obtained by the toner-exhaustion detecting unit 41.

The image forming apparatuses 10B to 10E have similar configuration as that of the image forming apparatus 10A. However, an image forming apparatus, out of the image forming apparatuses 10A to 10E, that functions as a master machine does not need to be equipped with the notifying unit 490, and image forming apparatuses that function as slave machines need not be equipped with the image data volume computing unit 43.

The toner-exhaustion detecting unit 41 employ generally known methods of, for example in the case of two component developing by toner and carrier (developing agent), forming an image pattern on a photosensitive medium, reading this image pattern optically, and detecting whether the image pattern density level is near to or has exhausted toner; or sensors to detect an amount of toner flow (magnetic permeability) for each toner using magnetic sensors. The toner-exhaustion detecting unit 41 processes measurements of remaining toners of each color.

Printing by use of four colors is performed because the color original is printed by expressing density of images through a convergence of cyan, magenta, yellow, and black line dots. The image data volume computing unit 43 performs color decomposition of digital images read by the scanner 200 and computes the volume of dots per sheet. This theoretical volume of dots is different from the actual amount of toner consumption. In other words, the actual amount of toner consumption is somewhat lower due to the adhesion ratio of developing toner. Since the toner adhesion ratio changes due to differing dot diameter, differing laser intensity, differing characteristics of a photosensitive medium due to temperature, and the like, it is necessary to prepare in advance by experimenting to find the relationships with theoretical values of toner consumption, store these toner consumption parameters on the ROM and the like, and refer to these parameters to compute amounts of toner consumption close to the actual amounts.

Figures 12, 13:
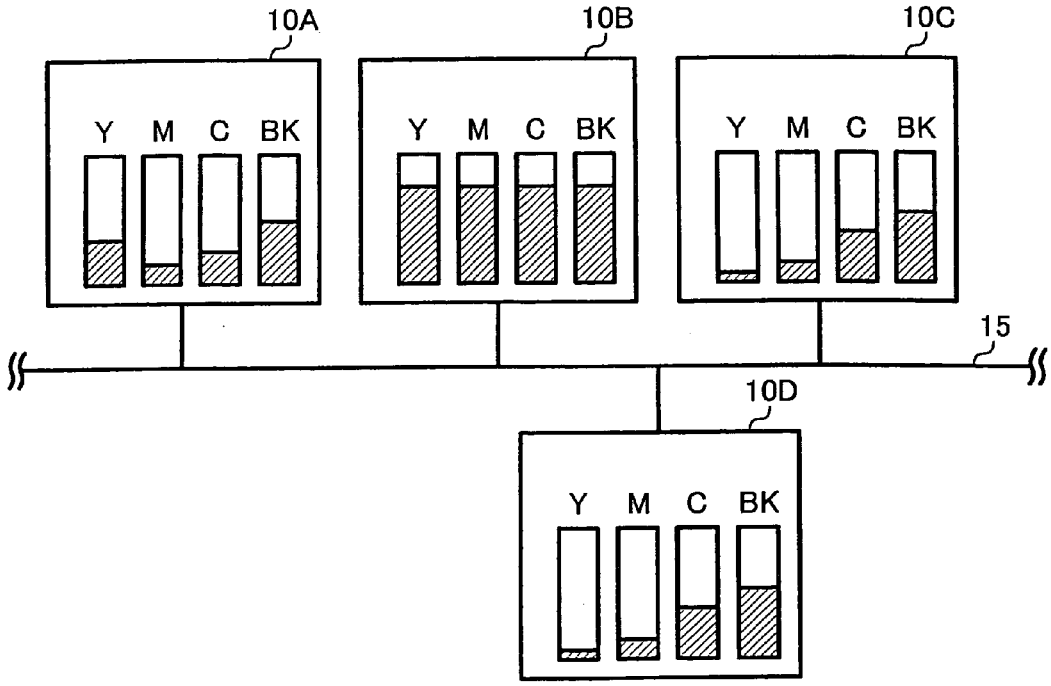
FIG. 12 is an explanatory drawing of toner consumption parameters stored in a read-only memory (ROM)
FIG. 13 is an explanatory drawing of amounts of remaining toners in each image forming apparatus connected to the network.

FIG. 12 is an explanatory table of sample toner consumption parameters stored in the ROM. Amounts of toner consumption required for printing 1000 pixels are correlated and stored for toners of each color. Although it is mentioned here to record the toner consumption per 1000 pixels, it is also permissible to compute toner consumption for each color corresponding to the number of pixels designated by the user if these parameters are computable.

FIG. 13 is an explanatory diagram of each remaining toner at the image forming apparatuses 10A to 10D, with remaining toner at four image forming apparatuses represented in a simplified manner. These amounts of remaining toner are, for example, recognized as 100% when new toner is set (completely filled up), and toner consumption is computed by subtraction from this completely filled up condition. The data about amounts of remaining toner of each machine is, when in linked operations mode, sent to at least the image forming apparatus which is used as the master machine. Then, these amounts of remaining toner are displayed on the liquid crystal touch-sensitive panel 31 when needed.

Figure 14:
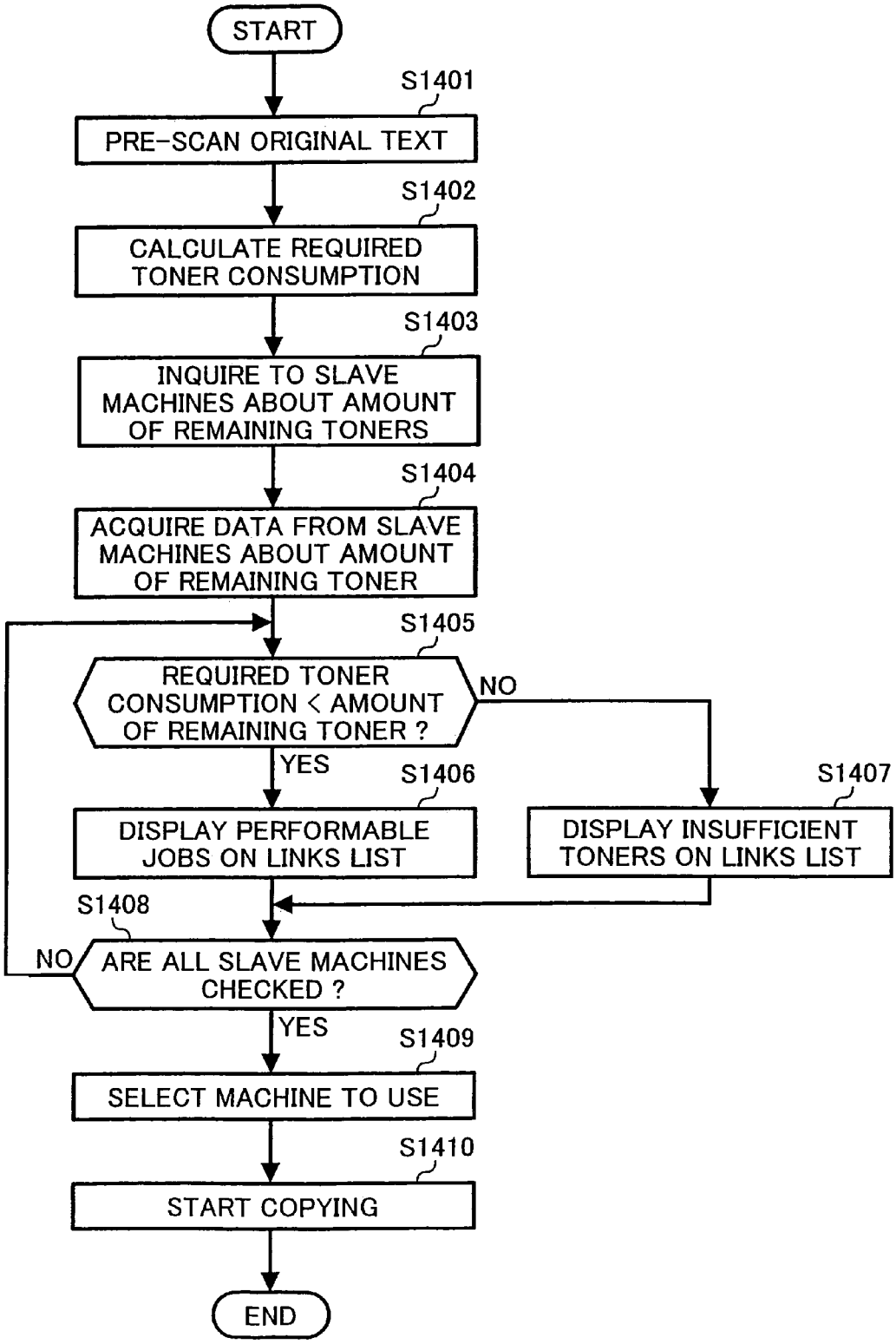
FIG. 14 is a flowchart of a slave machine selection process according to the first embodiment.

Next is an explanation of operations in linked mode. FIG. 14 is a flowchart of operations in a linked mode. The linked mode is activated when the link key (refer to FIG. 7) is pressed. During copying operations, if the start button is pressed, a pre-scan of all original texts (step S1401) is ordered by the main controller 20.

By conducting a pre-scan of the original texts, it is possible to know the amounts of toner consumption for the original texts, and it is possible to avoid reductions in productivity due to reduced image quality or toner-exhaustion by selection of the image forming apparatus (hereinafter, "slave machine") 10B according to the toner consumption and remaining toner at the slave machine 10B.

The image data volume computing unit 430 computes the amounts of toner consumption (step S1402) of each color from the number of pixels obtained through the pre-scan by referring to the toner consumption parameters of FIG. 12. The main controller 20 of the image forming apparatus (hereinafter, "master machine") 10A sends inquiries about remaining toners (step S1403) to each slave machine. At each slave machine, the toner-exhaustion detecting unit 41 detects the amounts remaining toners of each color and the notifying unit 490 send the information on the amounts remaining toners of each color to the master machine 10A. The main controller 20 of the master machine 10A acquires data on the amounts of remaining toner (step S1404) of each color from each slave machine. Moreover, the main controller 20 of the master machine 10A checks whether the required amounts of toner consumption for each color computed in S1402 is smaller than the amounts of remaining toners for each color acquired from the slave machines 10B (step S1405). If, for all of the colors, the required amounts of toner consumption is smaller than the remaining toners of each color acquired from the slave machines (step S1405: yes), then a list of linked machines is displayed according to FIG. 15 on the liquid crystal touch-sensitive panel 31 of the operations controlling unit 30 where the performable jobs of suitable machines is displayed (step S1406).

Figure 15:
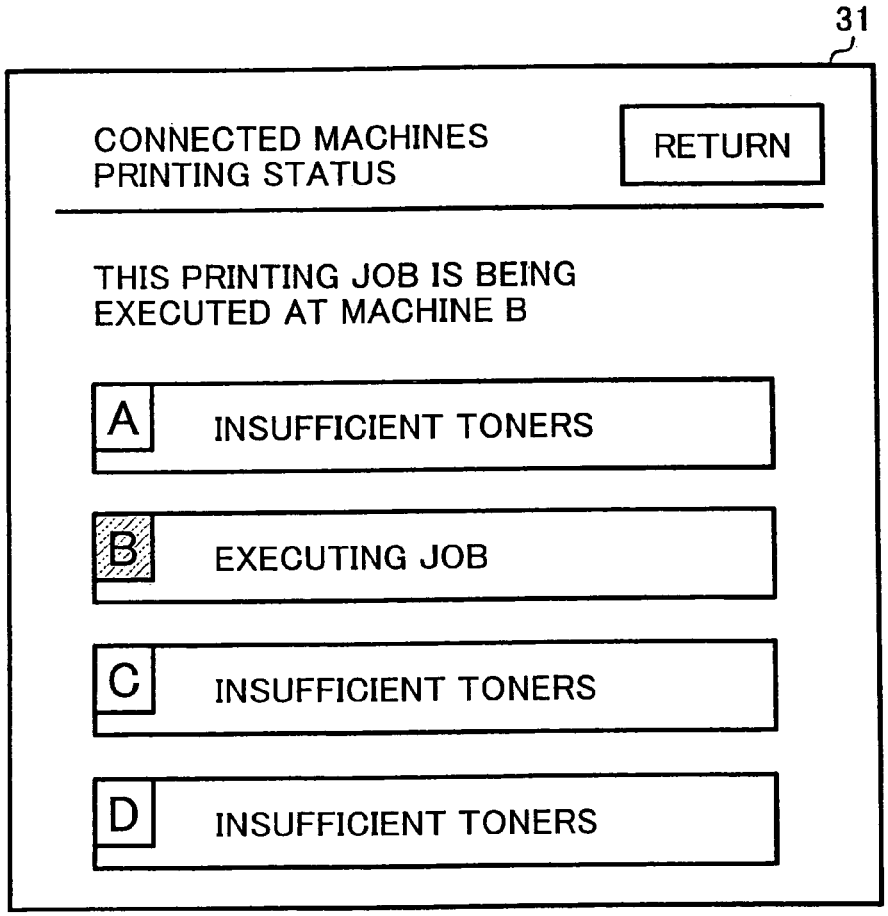
FIG. 15 is an explanatory diagram of a slave machine selection process for slave machines in linked mode according to the first embodiment.

On the other hand, in step S1405, if for all of the colors, the required amounts of toner consumption is larger than the remaining toners of each color acquired from the slave machines (step S1405: no), then a list of linked machines having insufficient remaining toner is displayed according to FIG. 15 on the liquid crystal touch-sensitive panel 31 of the operations controlling unit 30 (step S1407).

FIG. 15 is an explanatory drawing of an example of a linked machines list. In an embodiment according to FIG. 15, when an image forming apparatus having remaining toner that satisfies a computed required amount of image data is machine B, an indication that a printing job can be performed at machine B is displayed on the liquid crystal touch-sensitive panel 31.

Then, processing of steps S1405, S1406, or S1407 are performed for all slave machines (step S1408). When a user selects a slave machine from the linked machines list displayed according to the embodiment of FIG. 15 (step S1409), a command to start a copying job is sent to the selected slave machine from the master machine and the copying job starts at the selected slave machine 10B (step S1410).

In this case, each time the remaining toner of the slave machine changes, the master machine is notified about this change. For example, if magenta toner of the slave machine is exhausted, full color mode, (auto-color selection) ACS mode, two-color copying in red/black, all-red copying, or magenta copying cannot be selected. And if, for example, a linked function is selected for two-color copying in blue/ black and copying is being performed, printing operations of the slave machine are stopped and remaining printing is done at the master machine when the slave machine exhausts cyan toner or judges there is an insufficient amount of remaining toner. In this manner, the stopping of printing, according to the printing color used by a developing device which has exhausted its toner, will prevent a reduction in printing quality of image forming apparatuses.

In the first embodiment of a color image forming apparatus, a plurality of image forming apparatuses 10A, 10B, that form images of at least two or more colors, are connected on a network 15 that enables intercommunication between the image forming apparatuses. In the system which performs linked operations, the amount of toner consumption is computed for images to be printed, the amount of remaining toner of the color image forming apparatus and other machines for which toner consumption has been computed is confirmed, an image forming apparatus having sufficient toner for printing is selected, and printing is output. These linked operations make it possible to avoid the occurrence of situations of image degradation due to insufficient toner and stopping of a printing job.

In the first embodiment, a master machine selects a slave machine that is suitable for performing copying based on information obtained on the amount of toner in each of the slave machines. The information on the amount of toner is obtained just before start of the copying processing.

It is possible to configure a color image forming apparatus (master machine) to select a second slave machine if toner is exhausted in a first slave machine while the first slave machine is performing a copying job, and continue the copying job on the second slave machine. This case is explained below as a second embodiment according to the present invention.

Figures 16, 17:
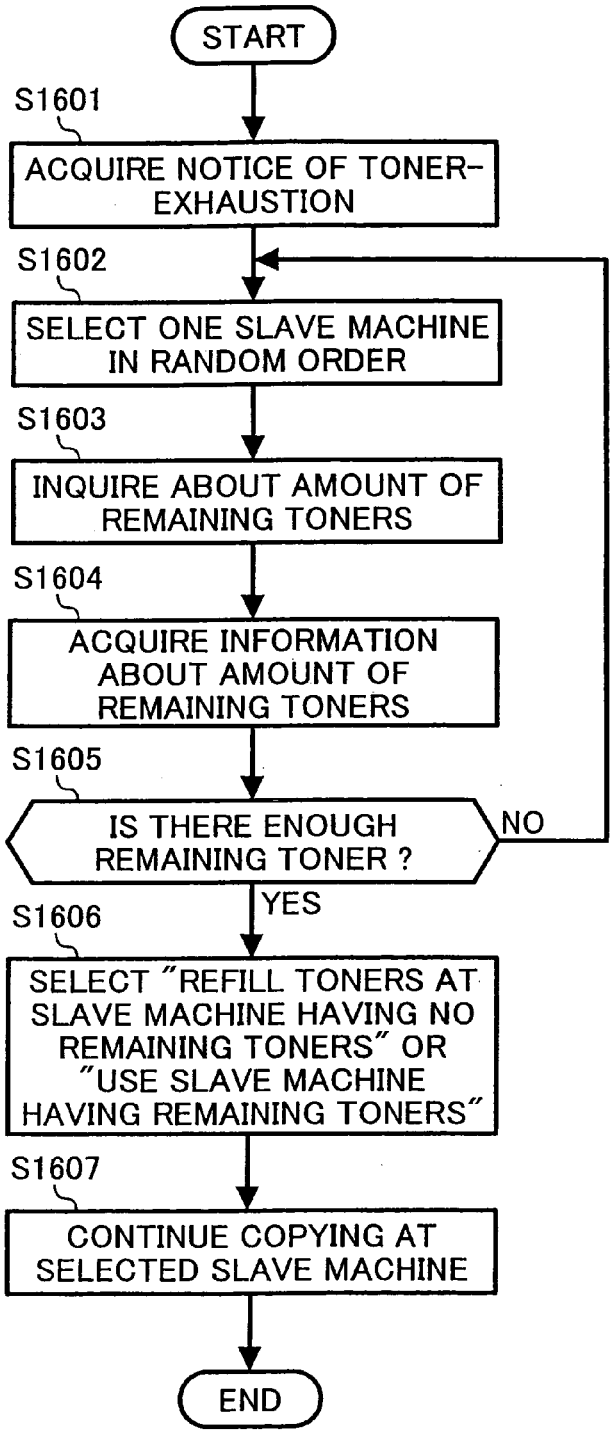
FIG. 16 is a flowchart of a slave machine selection process according to a second embodiment of the present invention.
FIG. 17 is an explanatory diagram of a sample slave machine selection display on an image forming apparatus according to the second embodiment.

An explanation of the configuration of a color image forming apparatus according to the second embodiment is omitted because the configuration is similar to the color image forming apparatus according to the first embodiment. Moreover, the main controller 20 of the following explanations of the second embodiment to a seventh embodiment is equivalent to the second controlling unit of the present invention. FIG. 16 is a flowchart of a slave machine selection process according to a second embodiment of the present invention.

Referring to FIG. 16, when toner for any of the colors is exhausted during the performance of a copying job, the toner-exhaustion detection unit 41 detects the absence of remaining, and the notifying unit 490 sends a notice of toner-exhaustion to the master machine 10A.

If the main controller 20 of the master machine 10A receives a notice of toner-exhaustion from a slave machine 10B while that slave machine is performing a copying job (step S1601), the main controller 20 selects any one of the slave machines 10C to 10E in a random order (step S1602), and inquires to the selected slave machine whether there is remaining toner (step S1603). The toner-exhaustion detecting unit 41 of the selected slave machine detects amount of remaining toner in that slave machine and the notifying unit 490 of the selected slave machine sends that information about the amounts of remaining toners to the master machine 10A. If there is no sufficient toner at the selected slave machine, the notifying unit 490 sends a notice of toner-exhaustion, instead of a notice of remaining toner. Further, it is acceptable to send a notice of "remaining toner: 0" if there is no remaining toner.

At the master machine 10A determines, based on information about remaining toners acquired from the selected slave machine (step S1604), whether there is enough remaining toner in the selected slave machine (step S1605). When the selected slave machine no remaining toner, in other words, toner is exhausted (step S1606: no), processing of steps S1602 to S1604 are performed by selecting a different slave machine.

On the other hand, in step S1605, if the master machine 10A judges that the selected slave machine has enough remaining toner (step S1605: yes), selection of another slave machine is stopped thereafter and the operations controlling unit 30 displays on the liquid crystal touch-sensitive panel 31 a request to the user to select either refilling toner at the slave machine 10B that was performing a copying job and has exhausted its toner (no remaining toner), or to select step S1602 which uses the selected slave machine that is judged to have enough remaining toner.

FIG. 17 is an explanatory diagram of a sample slave machine selection display on an image forming apparatus according to the second embodiment.

A job continuation command is sent from the master machine 10A to the slave machine 10B selected by the user on the slave machine selection display of FIG. 17, and the copying job is continued at the selected slave machine (step S1607). In other words, when the user, after refilling toner in the slave machine 10B and selecting the refill toner option for the slave machine 10B which had performed a copying job and exhausted its toner (no remaining toner), the slave machine 10B that was performing the copying job until that time is notified to continue the copying job. Or when the option to use the slave machine 10C having remaining toner is selected, the selected slave machine 10C is notified to continue the copying job.

In this manner, according to the second embodiment, a master machine selects a second slave machine when toner is exhausted at a first slave machine while the first slave machine is performing a copying job, and instructs the second machine to continue the copying job. So, even if remaining toner is exhausted during a copying job, the termination of image forming processing and reduction in the quality of performance of image forming apparatuses is prevented, and image forming processing can continue.

It is permissible to configure an image forming apparatus (master machine) to as to select the second slave machine in a predetermined order of priority instead of selecting the second slave machine in a random order. This case is explained below as a third embodiment according to the present invention.

Figure 18:
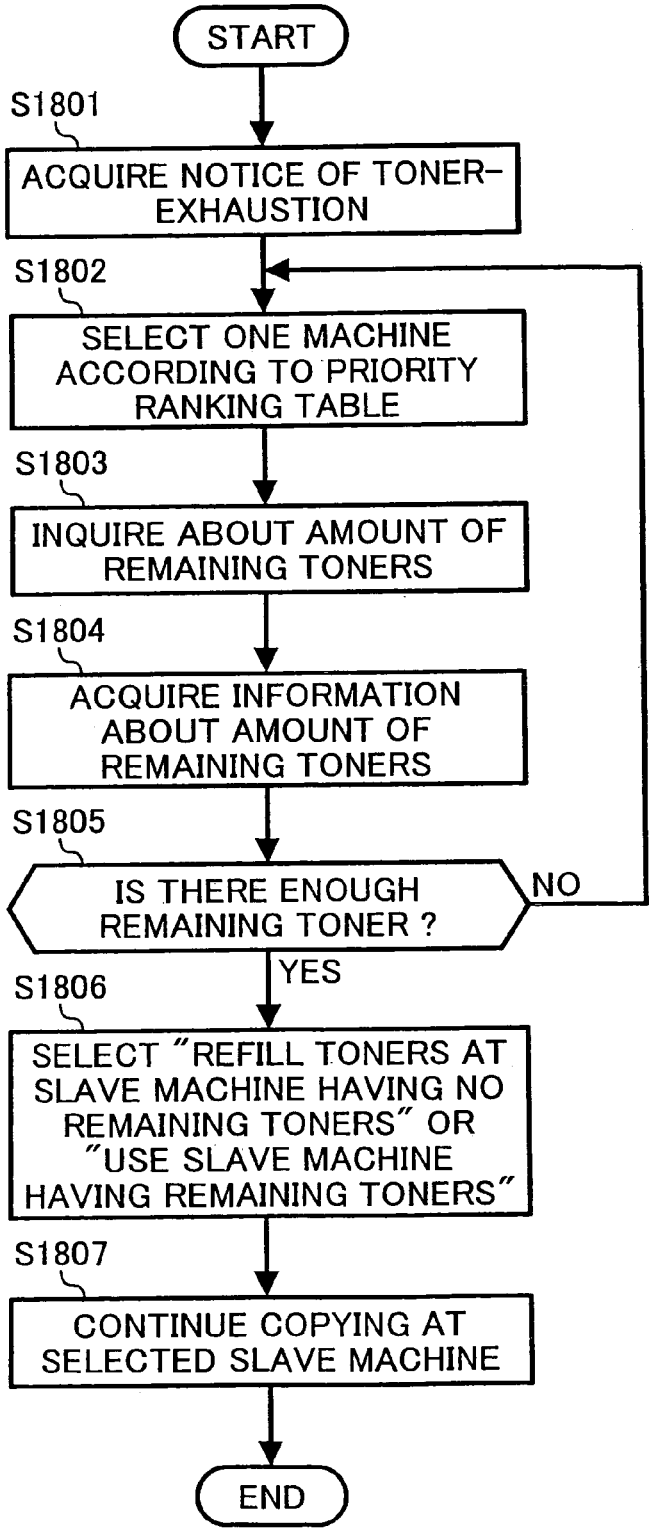
FIG. 18 is a flowchart of a slave machine selection process according to a third embodiment of the present invention.

An explanation of the configuration of a color image forming apparatus according to the third embodiment is omitted because the configuration is similar to the color image forming apparatus according to the first embodiment. FIG. 18 is a flowchart of a slave machine selection process according to a third embodiment of the present invention.

If the slave machine 10B is carrying out a copying job and the toner of any of the colors is exhausted, the toner-exhaustion detecting unit 41 of the slave machine 10B detects the exhaustion of remaining toner and the notifying unit 490 of the slave machine 10B sends a notice of toner-exhaustion to the master machine 10A.

When the main controller 20 of the master machine 10A acquires the notice of toner-exhaustion from the slave machine 10B (step S1801), the main controller 20 selects a slave machine according to a ranking order which is recorded beforehand in a priority ranking table that is stored in a RAM or hard-disk drive (HDD) of a storage unit (step S1802), and inquires to the selected slave machine about remaining toners (step S1803).

FIG. 19 is an explanatory diagram of a sample priority ranking table. The slave machine 10B, for example, is given priority when selecting slave machines. The priority ranking table is set in advance by an initial settings display of an image forming apparatus. Further, it is permissible to alter the priority ranking table at any point in time.

The toner-exhaustion detecting unit 41 of the selected slave machine detects remaining toners and the notifying unit 490 sends information about amounts of remaining toners to the master machine 10A. When there is no remaining toner at the selected slave machine, the notifying unit 490 sends a notice of toner-exhaustion instead of a notice of remaining toner. When there is no remaining toner, it is permissible to send a "remaining toner: 0" notice.

The master machine 10A judges, based on the information about the amounts of remaining toners acquired from the selected slave machine (step S1804), whether there is enough remaining toner in the selected slave machine (step S1805). If the selected slave machine has no remaining toner, or in other words, toner-exhaustion (step S1806: no), the master machine 10A selects the next slave machine 10B on the priority ranking order. The processes in steps S1802 to S1804 are performed corresponding to the next slave machine.

On the other hand, in step S1805, if the master machine 10A judges that the selected slave machine has enough remaining toner (step S1805: yes), the operations controlling unit 30 of the master machine 10A displays on the liquid crystal touch-sensitive panel 31 a request for a user to select either stopping the selection of slave machines and refill the slave machine 10B which exhausted its toner while performing the copying job, or to use the slave machine selected at step S1802 and which is judged to have enough remaining toner.

The master machine 10A sends a copying job continuation command to the slave machine selected by the user, and the selected slave machine continues the copying job (step S1807). In other words, after refilling toner of the slave machine 10B and selecting the option of refilling toner at the slave machine 10B that exhausted its toner (no remaining toner) while performing a copying job, the slave machine 10B that was performing the copying job until that time is notified that the copying job will continue. Or when the option to use another slave machine having enough remaining toner is selected, the selected slave machine is instructed to continue the copying job.

According to the third embodiment, a master machine selects a second slave machine when a first slave machine exhausts toner while performing a copying job, and the copying job is continued at the second slave machine. It is therefore possible, even if remaining toner is exhausted during a job, for an image forming process not to be aborted and to prevent a reduction in the quality of performance of an image forming apparatus. Further, at the color image forming apparatus according to the third embodiment, the convenience of a user is taken into consideration because it is possible for the user to prioritize and select a desired slave machine in advance since the slave machines are selected according to a priority ranking table.

It is permissible to configure a color image forming apparatus (master machine) to acquiring information about remaining toners from all the slave machines on the network 15, and make the user select a second slave machine to continue a printing job when a first slave machine exhausts toner while performing a copying job. This case is explained below as a fourth embodiment according to the present invention.

Figure 20:
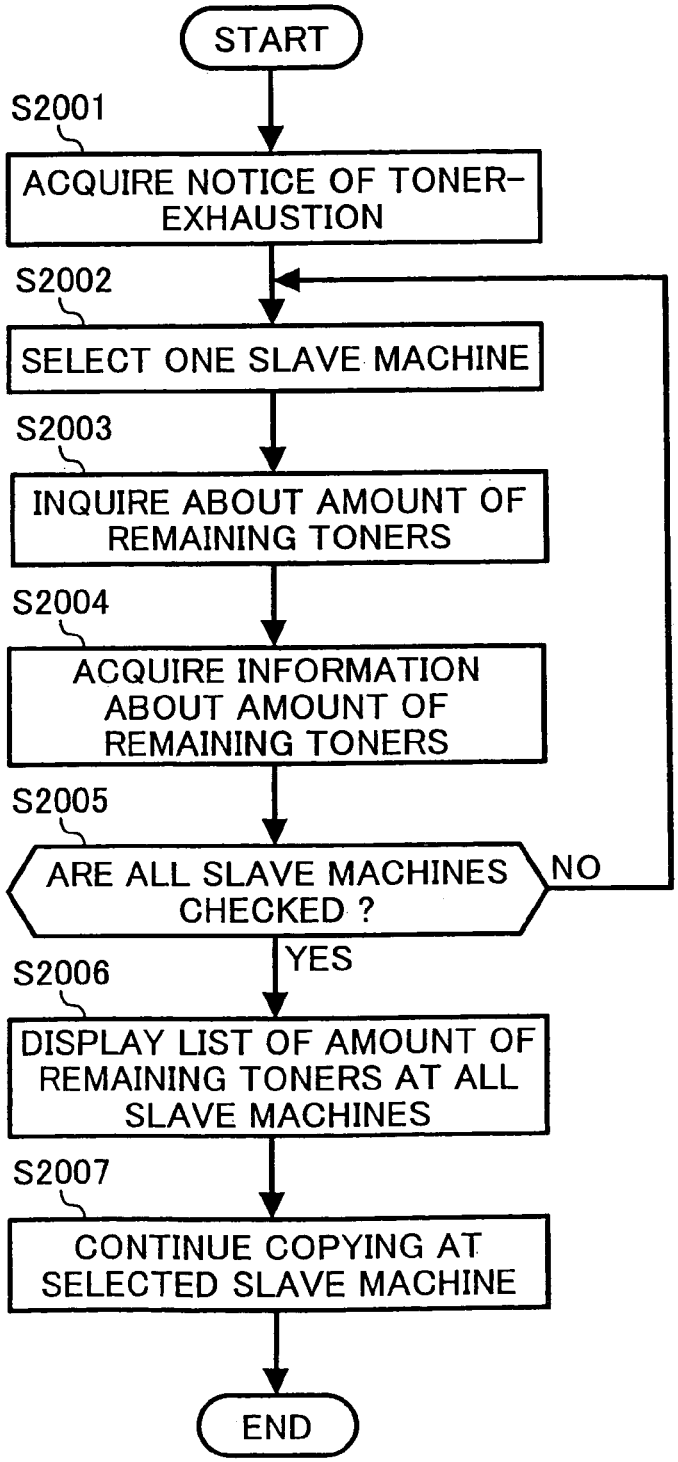
FIG. 20 is a flowchart of a slave machine selection process according to a fourth embodiment of the present invention.

An explanation of the configuration of a color image forming apparatus according to the fourth embodiment is omitted because the configuration is similar to the color image forming apparatus according to the first embodiment. FIG. 20 flowchart of a slave machine selection process according to a fourth embodiment of the present invention.

If a first slave machine has exhausted toner for any color while performing a copying job, the toner-exhaustion detecting unit 41 detects the absence of remaining toner and the notifying unit 490 sends a notice of toner-exhaustion to the master machine 10A.

The main controller 20 of the master machine 10A receives the notice of toner-exhaustion from the first slave machine (step S2001). Then, the main controller 20 selects a second slave machine according to a random or a predetermined order (step S2002), and sends an inquiry about amounts of remaining toners to the second slave machine (step S2003). The toner-exhaustion detecting unit 41 of the second slave machine detects the amounts of remaining toner and the notifying unit 490 sends remaining toner information to the master machine 10A.

The master machine 10A receives the remaining toner information from the second slave machine (step S2004). Steps S2002 to S2004 are then repeatedly performed on all remaining slave machines on the network (step S2005). In this way, information about remaining toners of all remaining slave machines is acquired.

The acquired information about remaining toners of all remaining slave machines is listed on the liquid crystal touch-sensitive panel 31 of the operations controlling unit 30 (step S2006). FIG. 21 is a sample display of a list of remaining toners of all remaining slave machines. According to FIG. 21, the remaining slave machines on the network are shown in the order of their appellations. For slave machines having no remaining toner, a "refill toner" tag is shown.

Then, the user selects a second slave machine from the display of all remaining slave machines, a copying job continuation command is sent to the second slave machine, and the second slave machine continues the copying job (step S2007). If the user refills toner at the first slave machine that showed a "refill toner" tag and then selects that first slave machine, the first slave machine will receive a notice to continue the copying job. Or if another second slave machine having enough remaining toner is selected that selected second slave machine receives a notice to continue the copying job.

In this manner, it is possible to continue image forming processing at a color image forming apparatus according to the fourth embodiment after acquiring information about the amount of remaining toners of all the slave machines on the network. The continuation of image forming processing at a refilled or an already sufficiently filled second slave machine chosen at the user's discretion prevents a reduction in the quality of the performance of the image forming apparatus.

It is also permissible to configure a color image forming apparatus (master machine) to acquire information about remaining toners from the slave machines on the network 15, list these slave machines according to a predetermined priority ranking table, and make the user select a second slave machine from the priority ranking table to continue a printing job when a first slave machine exhausts toner while performing a copying job. This case is explained below as a fifth embodiment according to the present invention.

Figure 22:
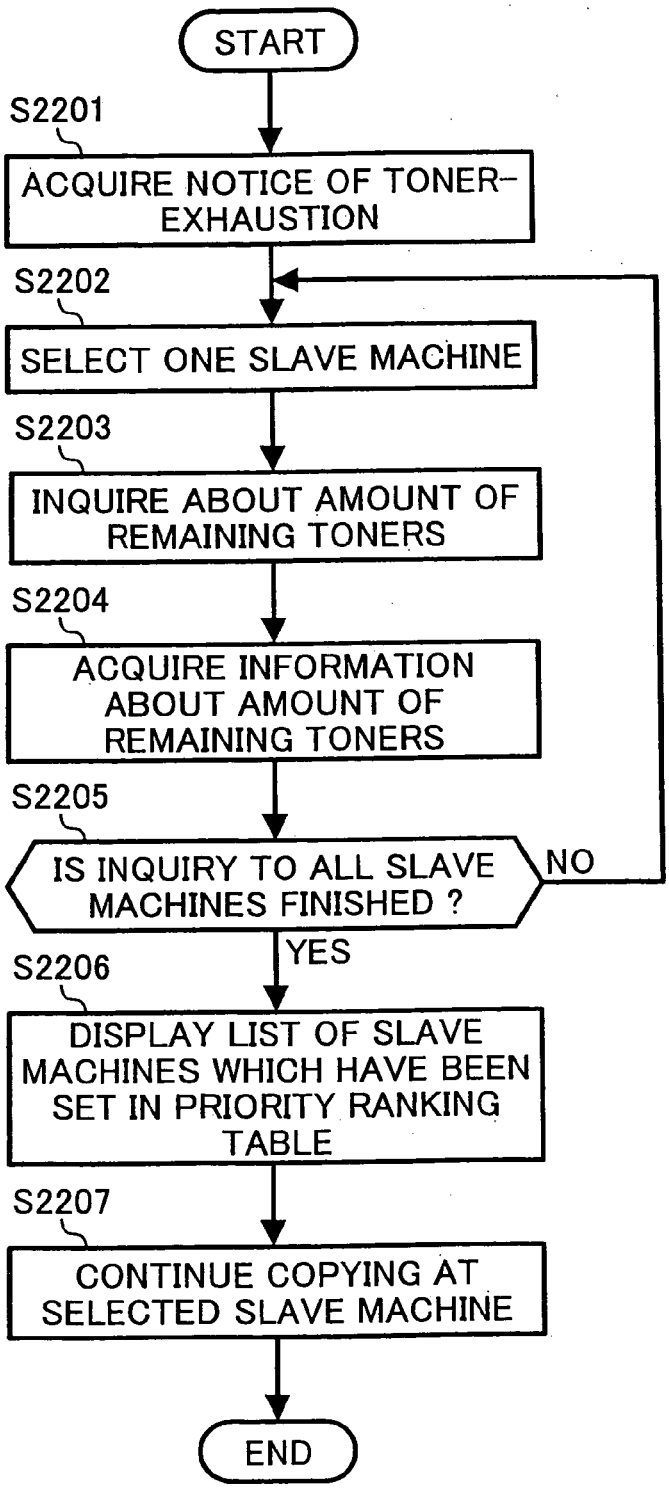
FIG. 22 is a flowchart of a slave machine selection process according to a fifth embodiment of the present invention.

An explanation of the configuration of a color image forming apparatus according to the fifth embodiment is omitted because the configuration is similar to the color image forming apparatus according to the first embodiment. FIG. 22 is a flowchart of the order of slave machine selection processing at the master machine 10A when it receives a notice of toner-exhaustion from a first slave machine which is performing a copying job according to the fifth embodiment.

At the first slave machine, when toner for any color is exhausted while performing a copying job, the toner-exhaustion detecting unit 41 detects the absence of remaining toner and a notice of toner-exhaustion is sent by the notifying unit 490 to the master machine 10A.

The main controller 20 of the master machine 10A performs the processes of acquiring the notice of toner-exhaustion from the first slave machine which is performing a copying job, selecting second slave machines according to a predetermined order of precedence, and acquiring information about the amounts of remaining toners of all slave machines on the network in the same manner as the fourth embodiment (steps S2001 to S2005).

The master machine 10A will, upon acquiring information about remaining toners of all slave machines on the network 15, display a list of those slave machines which have been previously set in a priority ranking table, on the liquid crystal touch-sensitive panel 31 of the operations controlling unit 30 (step S2206). The priority ranking table is similar to the priority ranking table according to the third embodiment.

Upon acquiring information about the amount of remaining toners of all slave machines on the network 15, the master machine 10A will, by means of its main controller 20, display the presence or absence of remaining toners of all slave machines on the priority ranking table displayed on the liquid crystal touch-sensitive panel 31 of the operations controlling unit 30.

Then, the user selects a second slave machine from the display of the priority ranking list of slave machines having enough remaining toners, a copying job continuation command is sent to the selected second slave machine, and the selected second slave machine continues the copying job (step S2207).

In this manner, the color image forming apparatus according to the fifth embodiment acquires information about amounts of remaining toners of all slave machines on the network 15, displays the status of remaining toners of slave machines on a priority ranking table of pre-selected slave machines, and allows the user to select a second slave machine. So even if remaining toner is exhausted while a job is being performed, a second image forming apparatus can, by being selected at the user's discretion, continue the image forming processing and prevent reduction in the quality of performance of an image forming apparatus. Further, a color image forming apparatus according to the fifth embodiment will display, according to a predetermined priority ranking of slave machines, the status of remaining toners of the slave machines. The convenience of the user is taken into consideration since it is possible for a user to easily prioritize slave machines in advance and select a desired second slave machine to continue a copying job.

It is also permissible to configure a color image forming apparatus (master machine) to make the color image forming apparatus (master machine) automatically select a second slave machine in a random order to continue a printing job when a first slave machine exhausts toner while performing a copying job. This case is explained below as a sixth embodiment according to the present invention.

The color image forming apparatuses of the second to fifth embodiments allow the user to select a slave machine to continue a copying job. But the color image forming apparatus according to the sixth embodiment will automatically select a second slave machine in a random order to continue a copying job.

Figure 23:
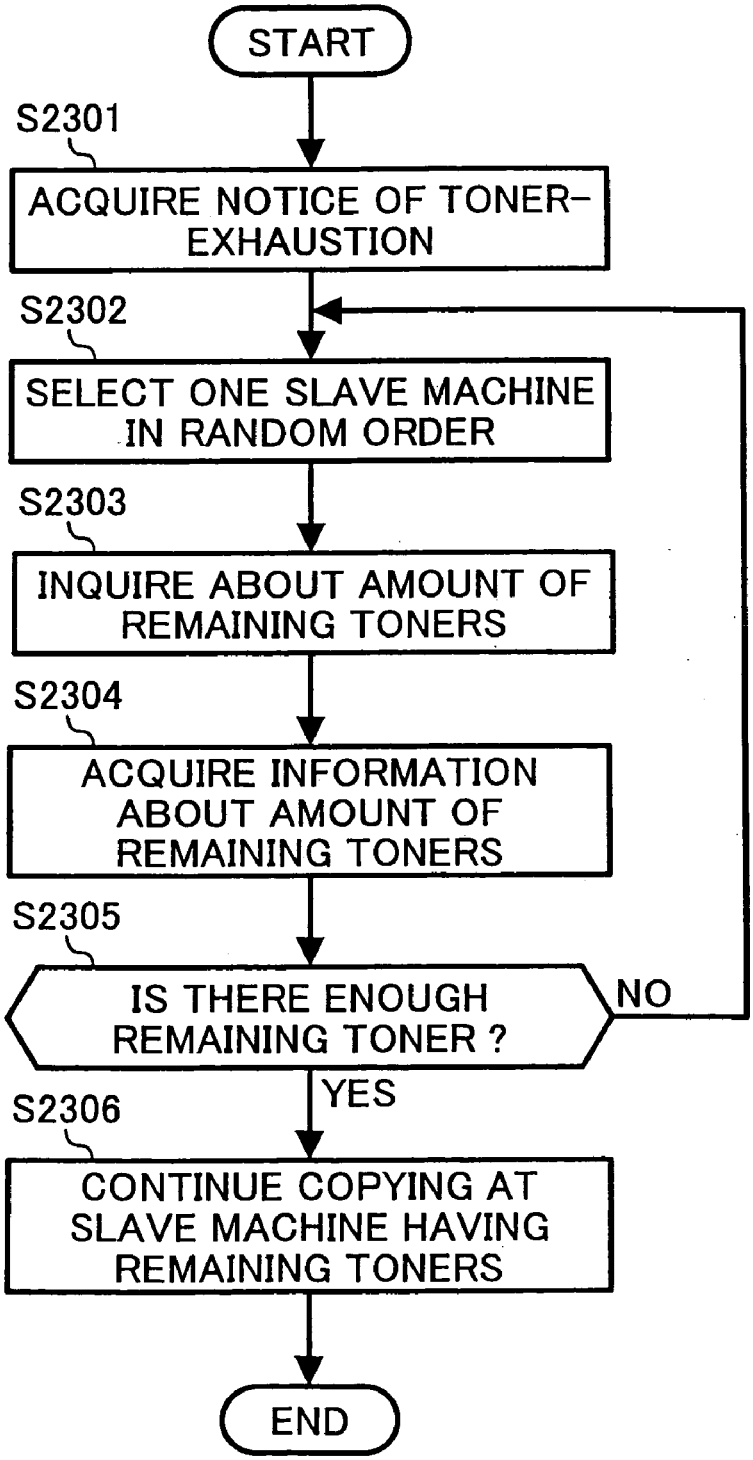
FIG. 23 is a flowchart of the slave machine selection process according to a sixth embodiment of the present invention.

An explanation of the configuration of a color image forming apparatus according to the sixth embodiment is omitted because the configuration is similar to the color image forming apparatus according to the first embodiment. FIG. 23 is a flowchart of the order of second slave machine selection processing at the master machine 10A when the master machine receives a notice of toner-exhaustion from a first slave machine while the first slave machine is performing a copying job according to the sixth embodiment.

At the first slave machine, when toner for any color is exhausted while a copying job is being performed, the toner-exhaustion detecting unit 41 detects the absence of remaining toner, and the notifying unit 490 sends a notice of toner-exhaustion to the master machine 10A.

When the main controller 20 of the master machine 10A receives a notice of toner-exhaustion from the first slave machine 10B while the first slave machine is performing a copying job (step S2301), the main controller 20 selects a second slave machine following a random order (step S2302), and sends an inquiry about the amount of remaining toners to the selected second slave machine (step S2303). At the second slave machine which receives an inquiry about the remaining toners, the toner-exhaustion detecting unit 41 detects the amount of remaining toners, and the notifying unit 490 sends information about the remaining toners to the master machine 10A.

At the master machine 10A, information about the amount of remaining toners is acquired from the second slave machine (step S2304), and an examination of whether remaining toner is present or absent is performed (step S2305). If there is no remaining toner at the selected second slave machine 10B, or in other words, toner-exhaustion (step S2306: no), the processing of steps S2302 to S2304 are performed on a different randomly selected second slave machine.

On the other hand, if in step S2305 the second slave machine that was selected in step S2302 is judged to have enough remaining toner (step S2305: yes), the second slave machine is sent a copying job continuation command, and the selected second slave machine continues the copying job (step S2306). By this process, the second slave machine which performs the copying job is automatically selected and the copying job is automatically continued.

At the color image forming apparatus according to the sixth embodiment, the second slave machine which continues the copying job is automatically selected to continue the copying job when toner is exhausted at a first slave machine during the performance of a copying job. So, even if toner is exhausted during a copying job, the image forming processing is not interrupted, and prevents a reduction in the quality of performance of an image forming apparatus. In the color image forming apparatus of the sixth embodiment, a second slave machine which continues a copying job is automatically selected by the color image forming apparatus (master machine), which is convenient for the user since the trouble of selecting a second slave machine is avoided.

It is also permissible to configure a color image forming apparatus (master machine) to make the color forming apparatus (master machine) select a second slave machine according to a priority ranking table of pre-selected slave machines to continue a printing job when a first slave machine exhausts toner while performing a copying job. The priority ranking table is similar to the table according to the third embodiment. This case is explained below as a seventh embodiment according to the present invention.

Figure 24:
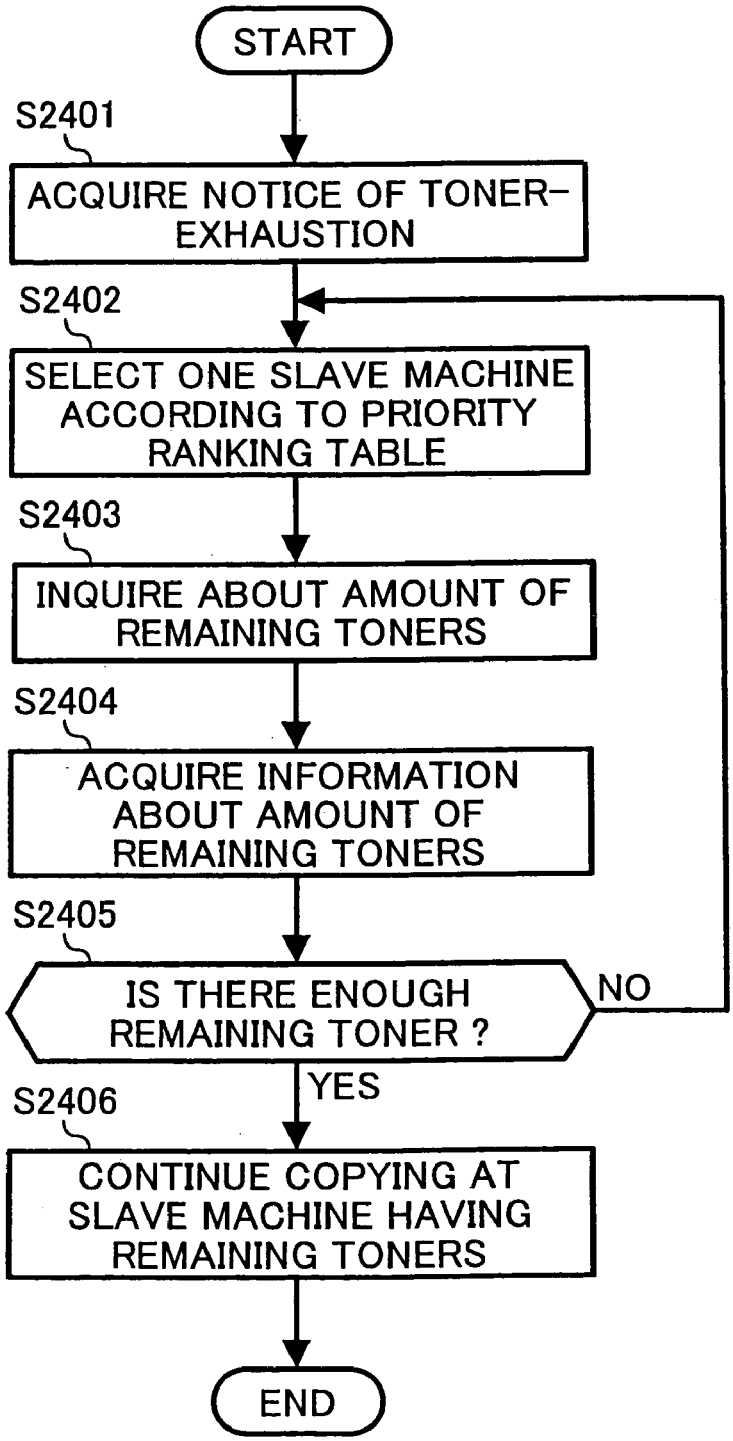
FIG. 24 is a flowchart of a slave machine selection process according to a seventh embodiment of the present invention.

An explanation of the configuration of a color image forming apparatus of the seventh embodiment is omitted because the configuration is similar to the color image forming apparatus according to the first embodiment. FIG. 24 is a flowchart of the order of second slave machine selection processing at the master machine 10A when the master machine receives a notice of toner-exhaustion from a first slave machine while the first slave machine is performing a copying job according to the seventh embodiment.

At the first slave machine, when toner of any color is exhausted during the performance of a copying job, the toner-exhaustion detecting unit 41 detects the absence of remaining toner, and the notifying unit 490 sends a notice of toner-exhaustion to the master machine 10A.

The main controller 20 of the master machine 10A receives a notice of toner-exhaustion from the first slave machine (step S2401). The main controller 20 then selects a second slave machine following the order of priority set in a priority ranking table (step S2402), and inquires to the selected second slave machine about the amount of remaining toners (step S2403). The subsequent processing (steps S2404 to S2406) are performed in a manner similar to the processing of the sixth embodiment (steps S2304 to S2306).

In the color image forming apparatus according to this seventh embodiment, during the automatic selection of the second slave machine to continue the copying job when toner is exhausted at the first slave machine during the performance of a copying job, the second slave machine is selected following the predetermined priority ranking of slave machines. So even if remaining toner is exhausted during the copying job, a reduction of the quality of the performance of an image forming apparatus is prevented because the image forming processing is not interrupted. Moreover, in the color image forming apparatus of the seventh embodiment, when the second slave machine for continuing a copying job is automatically selected, the selection is follows the predetermined priority ranking and the information about the amount of remaining toners is acquired. So a user can place the desired slave machines at a higher priority setting in the priority ranking, and the selection of the second slave machine can be performed automatically, which is convenient for the user.

Moreover, although in the first to seventh embodiments toner-exhaustion was when the amount of remaining toner was zero, it is also acceptable to configure toner-exhaustion at a fixed amount of remaining toner below which copying processing will not be performed.

In the first to seventh embodiments, a copying job has been explained as an example of an image forming operation, but the present invention can also be applied to image forming operations of other printing processing.

A computer program that executes the slave machine selection processing at the main controller 20 of the image forming apparatus is installed in advance and provided on the ROM existing within the main controller 20 or the ROM connected to the main controller 20.

It is acceptable to configure the computer program in an installable format or executable format file recorded and provided on a media, such as CD-ROM, flexible disk (FD), CD-R, digital versatile disk (DVD), and the like that is readable by the computer.

Furthermore, it is acceptable to store the computer program on a computer that is connected to a network, such as the Internet and the like, for download via the network. It is also acceptable to provide or distribute the computer program via the network.

The computer program has a modular configuration that executes each of the above procedures. The actual hardware is configured so the sections which execute each procedure is loaded on the main storage apparatus by the CPU, which executes the reading of the computer program from the ROM mentioned above.

In the first to seventh embodiments explained above, the main controller is equivalent to the first controlling unit and second controlling unit of the present invention. However, it is acceptable to make a configuration so the configuration that is equivalent to the second controlling unit operates on sections which are different from the main controller 20.

As explained above, the image forming apparatus network system relating to the present invention is connected to color copiers and color laser printers via a LAN or other network and is useful as a system to mutually send the image information and efficiently form the images. More particularly, the image forming apparatus network system of the present invention is applicable to mutual communication of digital image forming apparatuses which form images of two or more colors, digital scanners, and personal computers; and manages the amounts of the remaining toners of the connected image forming apparatuses when the color images are formed and enables printing of the image information.

Although the invention has been described with respect to a specific embodiment for a complete and clear disclosure, the appended claims are not to be thus limited but are to be construed as embodying all modifications and alternative constructions that may occur to one skilled in the art which fairly fall within the basic teaching herein set forth.

What is claimed is:

1. An image forming apparatus network system comprising a first image forming apparatus connected to a plurality of second image forming apparatuses over a network, wherein the first image forming apparatus includes, an image creating unit that creates an image with at least one toner based on an image data to be printed, an image data volume computing unit that computes a volume of the image data, a remaining toner information acquiring unit that acquires information on remaining toner from at least one second image forming apparatus of second image forming apparatuses, and a controlling unit that computes toner consumption from the volume of image data computed by the image data volume computing unit, selects a second image forming apparatus that has an amount of remaining toner larger than the computed toner consumption, and sends a command to form an image at the selected second image forming apparatus; and each of the second image forming apparatuses includes, a toner detecting unit that detects an amount of remaining toner in a corresponding second image forming apparatus, and a notifying unit that notifies the first image forming apparatus of information regarding the remaining toner detected by the toner detecting unit.

2. An image forming apparatus, which is connected via a network to a plurality of other image forming apparatuses, comprising:

an image creating unit that receives image data to be printed and based on the image data forms images with at least one toner;

an image data volume computing unit that computes a volume of the image data;

a remaining toner information acquiring unit that acquires information on remaining toner from at least one of the other image forming apparatuses; and a controlling unit that computes toner consumption from the volume of image data computed by the image data volume computing unit, selects an image forming apparatus, from among the other image forming apparatuses, that has an amount of remaining toner larger than the computed toner consumption, and sends a command to form an image at the selected other image forming apparatus.

3. The image forming apparatus according to claim 2, further comprising an image reading unit that reads images of a plurality of original texts to thereby obtain the image data for each original text, wherein the image data volume computing unit computes the volume of the image data based on total amount of image data obtained by the image reading unit.

4. The image forming apparatus according to claim 2, wherein the controlling unit controls the image creating unit to form the image if the remaining toner information acquiring unit receives a notice that remaining toner in the other image forming apparatus has fallen below a specified amount during forming the image from the other image forming apparatus.

5. The image fonning apparatus according to claim 2, further comprising a displaying unit that displays the amount of remaining toner based on the information acquired by the remaining toner information acquiring unit.

6. The image forming apparatus according to claim 2, wherein the image creating unit creates images by each of the colors yellow, magenta, cyan, and black, and the remaining toner information acquiring unit acquires information about the remaining toner of each color.

7. The image forming apparatus according to claim 2, wherein when the information acquired by the remaining toner information acquiring unit indicates that the other image forming apparatus, which is forming the image, has remaining toner below a specified amount, the controlling unit selects another one of the other image forming apparatuses that has remaining toner above the specified amount and sends the command to continue formation of the image to the another one of the other image forming apparatuses.

8. The image forming apparatus according to claim 2, wherein when the information acquired by the remaining toner information acquiring unit indicates that the other image forming apparatus, which is forming the image, has remaining toner below a specified amount, the remaining toner information acquiring unit acquires information on remaining toner from at least another one of the other image forming apparatuses in a random order, the image forming apparatus further comprising a display unit that displays information so as to cause a user to select one other image forming apparatus from among the least another one of the other image forming apparatuses, and wherein the controlling unit sends the command to continue formation of the image to the other image forming apparatus selected by the user.

9. The image forming apparatus according to claim 2, wherein when the information acquired by the remaining toner information acquiring unit indicates that the other image forming apparatus, which is forming the image, has remaining toner below a specified amount, the remaining toner information acquiring unit acquires information on remaining toner from at least another one of the other image forming apparatuses in a predetermined priority order, the image forming apparatus further comprising a display unit that displays information so as to cause a user to select one other image forming apparatus from among the least another one of the other image forming apparatuses, and wherein the controlling unit sends the command to continue formation of the image to the other image forming apparatus selected by the user.

10. The image forming apparatus according to claim 2, wherein when the information acquired by the remaining toner information acquiring unit indicates that the other image forming apparatus, which is forming the image, has remaining toner below a specified amount, the remaining toner information acquiring unit acquires information on remaining toner from at least those other image forming apparatuses that are not forming images; and the image forming apparatus further comprising a display unit that displays information so as to cause a user to select one other image forming apparatus from at least those other image forming apparatuses that are not forming images, and wherein the controlling unit sends the command to continue formation of the image to the other image forming apparatus selected by the user.

11. The image forming apparatus according to claim 10, wherein the display unit displays information about the at least those other image forming apparatuses that are not forming images in a predetermined priority order.

12. The image forming apparatus according to claim 2, wherein when the information acquired by the remaining toner information acquiring unit indicates that the other image forming apparatus, which is forming the image, has remaining toner below a specified amount, the remaining toner information acquiring unit acquires information on remaining toner from a plural ones of the other image forming apparatuses in a random order and timing of acquiring of the information on remaining toner from each of the other image forming apparatuses, and the controlling unit selects another one of the other image forming apparatuses that has remaining toner above the specified amount as well as whose timing recorded by the remaining toner information acquiring unit is earliest and sends the command to continue formation of the image to the another one of the other image forming apparatuses.

13. The image forming apparatus according to claim 2, wherein when the information acquired by the remaining toner information acquiring unit indicates that the other image forming apparatus, which is forming the image, has remaining toner below a specified amount, the remaining toner information acquiring unit acquires information on remaining toner from a plural ones of the other image forming apparatuses in a predetermined priority order and timing of acquiring of the information on remaining toner from each of the other image forming apparatuses, and the controlling unit selects another one of the other image forming apparatuses that has remaining toner above the specified amount as well as whose timing recorded by the remaining toner information acquiring unit is earliest and sends the command to continue formation of the image to the another one of the other image forming apparatuses.

14. An image forming apparatus selection method to be executed on a first image forming apparatus connected to a plurality of second image forming apparatuses over a network, comprising:

the first image forming apparatus executing, computing a volume of an image data to be printed, acquiring information on remaining toner from at least one of second image forming apparatuses, computing a toner consumption from the volume of the computed image data, selecting a second image forming apparatus that has an amount of remaining toner larger than the computed toner consumption, and sending a command to form an image at the selected second image forming apparatus; and each of the second image forming apparatuses executing, detecting an amount of remaining toner in a corresponding second image forming apparatus, and notifying the first image forming apparatus of information regarding the detected remaining toner.

15. An image forming apparatus selection method to be executed on an image forming apparatus connected with a plurality of other image forming apparatuses over a network, comprising:

computing a volume of an image data to be printed;

acquiring information on remaining toner from at least one of the other image forming apparatuses;

computing a toner consumption from the computed volume of image data;

selecting one of the other image forming apparatus that has an amount of remaining toner larger than the computed toner consumption; and sending a command to form an image at the selected other image forming apparatus.

16. A computer program that causes a computer to execute an image forming apparatus selection method to be executed on an image forming apparatus connected with a plurality of other image forming apparatuses over a network, comprising:

computing a volume of an image data to be printed;

acquiring information on remaining toner from at least one of the other image forming apparatuses;

computing a toner consumption from the computed volume of image data;

selecting one of the other image forming apparatus that has an amount of remaining toner larger than the computed toner consumption; and sending a command to form an image at the selected other image forming apparatus.

17. A computer-readable recording medium that stores therein a computer program that causes a computer to execute an image forming apparatus selection method to be executed on an image forming apparatus connected with a plurality of other image forming apparatuses over a network, comprising:

computing a volume of an image data to be printed;

acquiring information on remaining toner from at least one of the other image forming apparatuses;

computing a toner consumption from the computed volume of the image data;

selecting one of the other image forming apparatus that has an amount of remaining toner larger than the computed toner consumption; and sending a command to form an image at the selected other image forming apparatus.

* * * * *